US010483694B2

(12) United States Patent
Crowder

(10) Patent No.: US 10,483,694 B2
(45) Date of Patent: Nov. 19, 2019

(54) LOCK-IN SECURABLE ELECTRICAL PLUG ADAPTER AND METHOD OF USE

(71) Applicant: Robert W. Crowder, Chicago, IL (US)

(72) Inventor: Robert W. Crowder, Chicago, IL (US)

( * ) Notice: Subject to any disclaimer, the term of this patent is extended or adjusted under 35 U.S.C. 154(b) by 0 days.

(21) Appl. No.: 16/235,573

(22) Filed: Dec. 28, 2018

(65) Prior Publication Data

US 2019/0140397 A1 May 9, 2019

Related U.S. Application Data

(63) Continuation-in-part of application No. 15/725,224, filed on Oct. 4, 2017, now Pat. No. 10,181,680.

(51) Int. Cl.

| | |
|---|---|
| ***H01R 13/625*** | (2006.01) |
| ***H01R 13/639*** | (2006.01) |
| ***H01R 31/06*** | (2006.01) |
| ***H01R 13/58*** | (2006.01) |
| ***H01R 13/447*** | (2006.01) |
| *H01R 24/78* | (2011.01) |

(52) U.S. Cl.

CPC ..... *H01R 13/6395* (2013.01); *H01R 13/447* (2013.01); *H01R 13/5825* (2013.01); *H01R 31/06* (2013.01); *H01R 24/78* (2013.01)

(58) Field of Classification Search

CPC ..... H01R 13/652; H01R 27/00; H01R 31/02; H01R 13/6275; H01R 13/20; H01R 25/006; H01R 31/06; H01R 25/003

USPC ..... 439/102–107, 345, 346, 650–655

See application file for complete search history.

(56) References Cited

U.S. PATENT DOCUMENTS

| | | | | |
|---|---|---|---|---|
| 1,341,468 | A | 5/1920 | Kenney | |
| 1,511,855 | A | 10/1924 | Wentz | |
| 1,976,501 | A | 10/1934 | James | |
| 2,002,558 | A | 5/1935 | Von Holtz | |
| 2,199,560 | A | 5/1940 | Faller | |
| 2,436,586 | A | 2/1948 | Mangold | |
| 3,161,450 | A | 12/1964 | Goodenough | |
| 3,579,283 | A | 5/1971 | Welburn | |
| 3,775,727 | A | 11/1973 | Wise | |
| 4,061,409 | A | 12/1977 | Bealmear | |
| 4,494,809 | A | 1/1985 | Soloman | |
| 4,500,160 | A * | 2/1985 | Bertsch | H01R 31/00 439/490 |
| 4,579,410 | A | 4/1986 | Soloman | |
| 4,954,091 | A * | 9/1990 | Marble | H01R 13/652 439/103 |
| 5,007,857 | A * | 4/1991 | Wright | H01R 13/717 439/490 |

(Continued)

*Primary Examiner* — Thanh Tam T Le

(74) *Attorney, Agent, or Firm* — Law Office of Mark Brown, LLC; Christopher M. DeBacker

(57) ABSTRACT

A lock-in adapter having a locking arm ending in a latch contained within a ground pin for securing the adapter into a wall outlet via the ground pin receiver. Internal locking arms similarly lock and retain a plug inserted into the opposite end of the adapter, thereby securing the plug to the adapter and the adapter to the wall. The adapter can be further secured to the outlet faceplate via screws through tabs located on both the top and bottom ends of the adapter. A button secures the various latches to secure the plug and adapter, and which can be selectively operated to release both the adapter from the outlet and the plug from the adapter.

18 Claims, 30 Drawing Sheets

(56) References Cited

U.S. PATENT DOCUMENTS

| | | | | | |
|---|---|---|---|---|---|
| 5,249,976 | A * | 10/1993 | Brock | H01R 13/20 | 439/102 |
| 5,409,397 | A * | 4/1995 | Karman | H01R 13/6335 | 439/105 |
| 5,480,318 | A * | 1/1996 | Garrison | H01R 13/20 | 439/102 |
| 5,551,884 | A | 9/1996 | Burkhart, Sr. | | |
| 5,590,010 | A * | 12/1996 | Ceola | H01R 13/7137 | 337/13 |
| 6,171,129 | B1 * | 1/2001 | Phillips | H01R 13/193 | 439/263 |
| 6,315,593 | B1 | 11/2001 | Bentley et al. | | |
| 6,419,504 | B1 * | 7/2002 | Nelson | H01R 13/652 | 439/103 |
| 6,753,755 | B2 | 6/2004 | Montague | | |
| 6,875,040 | B1 * | 4/2005 | O'Keefe | H01R 13/6392 | 439/346 |
| 7,077,683 | B1 | 7/2006 | Ross | | |
| 7,220,136 | B1 * | 5/2007 | Green | H01R 25/00 | 439/106 |
| 7,798,838 | B2 | 9/2010 | Grieff et al. | | |
| 8,668,516 | B2 | 3/2014 | Lee | | |
| 8,808,014 | B2 * | 8/2014 | Hsu | H01R 24/28 | 439/133 |
| 9,147,973 | B1 | 9/2015 | Madison | | |
| 9,197,018 | B2 | 11/2015 | Garofalo et al. | | |
| 9,825,414 | B2 | 11/2017 | Armstrong et al. | | |
| 2013/0337675 | A1 | 12/2013 | Cai et al. | | |
| 2014/0213093 | A1 | 7/2014 | Tal et al. | | |

* cited by examiner

LOCK-IN SECURABLE ELECTRICAL PLUG ADAPTER AND METHOD OF USE

CROSS-REFERENCE TO RELATED APPLICATION

This application is a continuation in part of and claims priority in U.S. patent application Ser. No. 15/725,224 filed Oct. 4, 2017, which is incorporated herein by reference.

BACKGROUND OF THE INVENTION

1. Field of the Invention

The present disclosure is generally directed to power adapters for mobile phones and other electronic devices, and more particularly to a power adapter that can be inserted and selectively secured into a standard outlet socket.

2. Description of the Related Art

With the ubiquitous presence of electronic devices such as mobile phones, tablet computers, and laptop computers, and the current state of battery and charging technology, users of such devices are often in need of solutions for charging the batteries and powering up such devices while they are outside of their home or in a public or shared space. Some public or private accommodations offer the use of wireless charging stations, but these are often only compatible with a small subset of devices.

Offering charging solutions for a larger range of devices typically involves leaving power adapters plugged into a wall outlet in an unsecured manner. Power adapters that are plugged in but not secured may be accidentally removed from the outlet, or may be purposely removed and stolen or broken. The connections and cords may also be removed from the Power Supply Unit (PSU) of unsecured adapters, and stolen or broken. Alternately, adapters may be secured with means that are not specifically designed for such adapters and thus are unwieldy or easily overcome.

U.S. Pat. No. 9,147,973 describes an "enclosure for wall charger" that allows a power adapter to be secured to a wall outlet and a power cord to be secured to the enclosure. The device described is a plastic casing that is molded to go over a PSU. The device described suffers from the drawbacks of only being compatible with specific devices (principally Apple's iPhone) and power adapters due to the shape and size of the enclosure. The device described also suffers from the drawbacks of only allowing for one orientation when inserted into a wall socket due to the presence of only a single fastening tab for securing the enclosure to a wall socket, and requiring additional equipment such as a zip tie in order to secure a power adapter cord.

With the ubiquitous nature of electrical products and their respective adapters, inadvertent removal of plugs and adapters from power outlets is a common issue for everyone. An accidental removal of a plug can cause minimal inconveniences or could lead to serious issues, such as causing a computer to become unplugged losing valuable work progress, or requiring workers to move up and down ladders and scaffolding to plug in cords which have accidentally become unplugged, wasting time and risking injury.

Other existing products for securable and locking plug devices exist, but are generally limited to a single locking blade within a male power prong of the adapter, which can fail to secure the adapter to the outlet. These products also tend to be more permanent solutions and are not easily replaceable and reusable with multiple products. One such device is U.S. Pat. No. 7,798,838 which requires a permanent attachment to the adapter. Another is U.S. Pat. No. 6,171,129 which outlines similar issues that can be presented with existing products.

It would be useful to have a power adapter that can be secured into a wall socket and can secure a plug attached to it, without the drawbacks of existing securing solutions.

BRIEF SUMMARY OF THE INVENTION

In one example of a securable power adapter according to this invention, the power adapter has an adapter body, one or more female receptacles in one surface of the adapter body, a cord-fastening means on a surface of the adapter body, male prongs extending from another surface of the adapter body, and one or more fastening tabs extending from a surface of the adapter body. The female receptacles can be designed to accept standard corded connections widely accepted in use with electronic devices (e.g. mobile phones, tablets, and other personal electronic devices) such as male ends of various USB (Universal Serial Bus) standards or Apple's Lightning connector. The male prongs can be designed to fit into a standard wall outlet, and optionally can be designed to fold into the adapter body when not in use.

In another example of a securable power adapter according to this invention, the power adapter has an adapter body, a cord connection protruding from a surface of the adapter body, male prongs extending from another surface of the adapter body, and one or more fastening tabs extending from a surface of the adapter body. The male prongs can be designed to fit into a standard wall outlet, and optionally can be designed to fold into the adapter body when not in use.

Another embodiment of the present invention features a lock-in adapter which can securely lock the adapter into a wall outlet by using a latch and latch arm within the ground pin of the adapter. Similarly, locking arms within the adapter will lock onto a plug's male prongs when inserted into the adapter. This locks both the plug into the adapter and the adapter into the wall, preventing accidental removal. A button can be depressed to release both the adapter from the wall and the plug form the adapter.

These as well as other aspects, advantages, and alternatives, will become apparent to those of ordinary skill in the art by reading the following detailed description, with reference where appropriate to the accompanying drawings.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Securable Power Adapter

Figure 1:
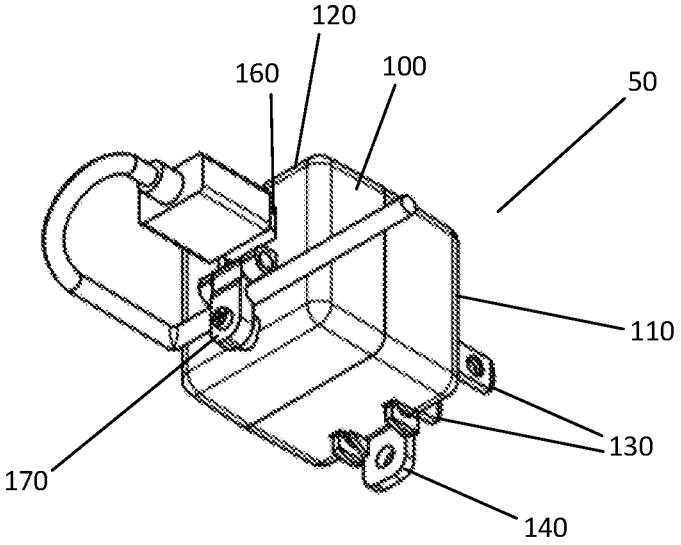
FIG. 1 is an isometric view of an example embodiment showing the surface containing a female receptacle and cord-fastening means.

In the particular embodiment illustrated in FIG. 1, the power adapter 50 includes an adapter body 100, a male end 110, and a female end 120. The adapter body 100 has a rectangular or polygon shape. The adapter body 100 is composed of any suitable, non-conductive material, such as molded plastic or hard rubber, and is fabricated using any suitable process. The adapter body 100 is substantially rigid, and durable enough to provide a protective cover for the internal components.

Figure 2:
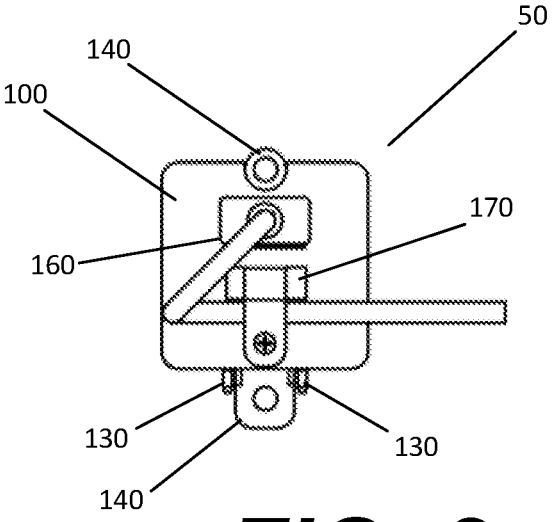
FIG. 2 is a front view of an example embodiment.
Figure 3:
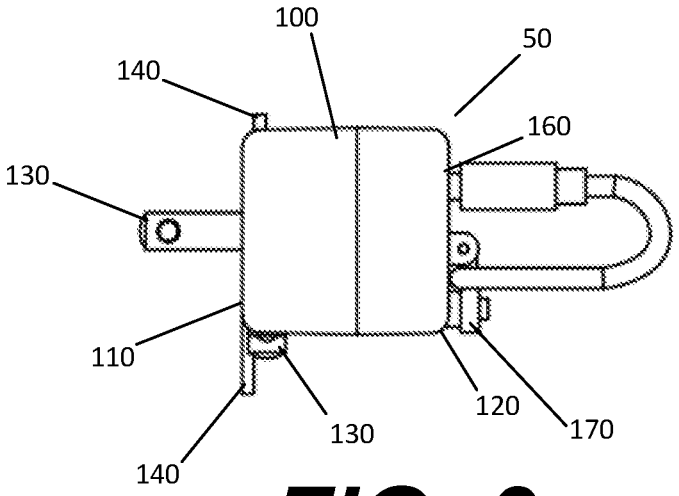
FIG. 3 is a side view of an example embodiment.
Figure 4:
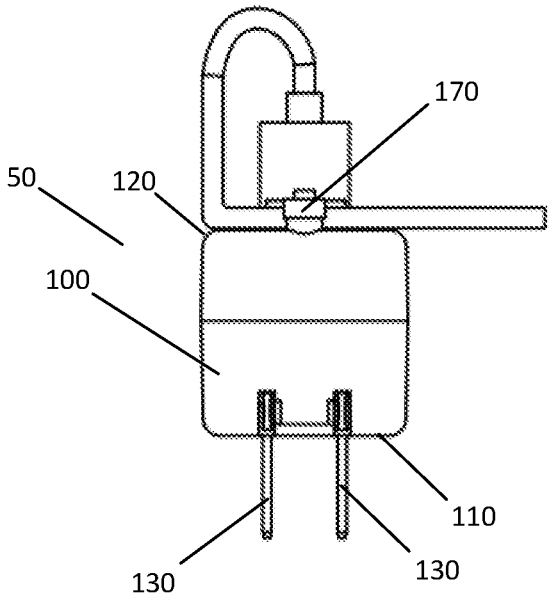
FIG. 4 is a bottom view of an example embodiment.
Figure 5:
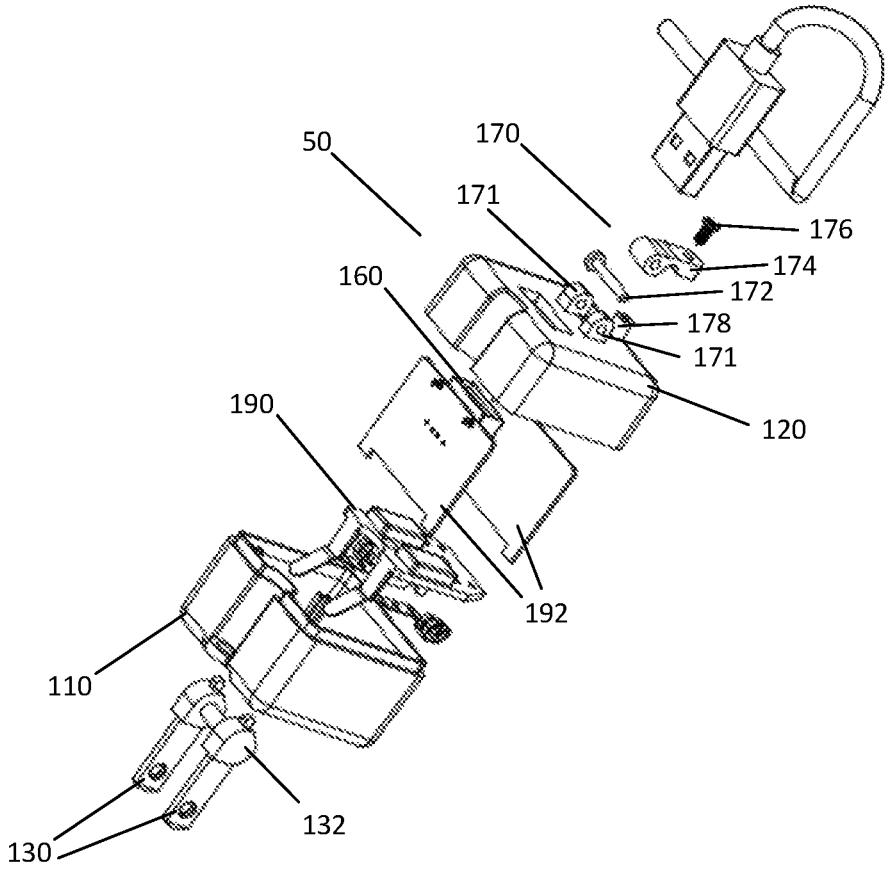
FIG. 5 is an isometric exploded view of the internal structure of an example embodiment showing a USB connection and foldable male prongs.
Figure 6:
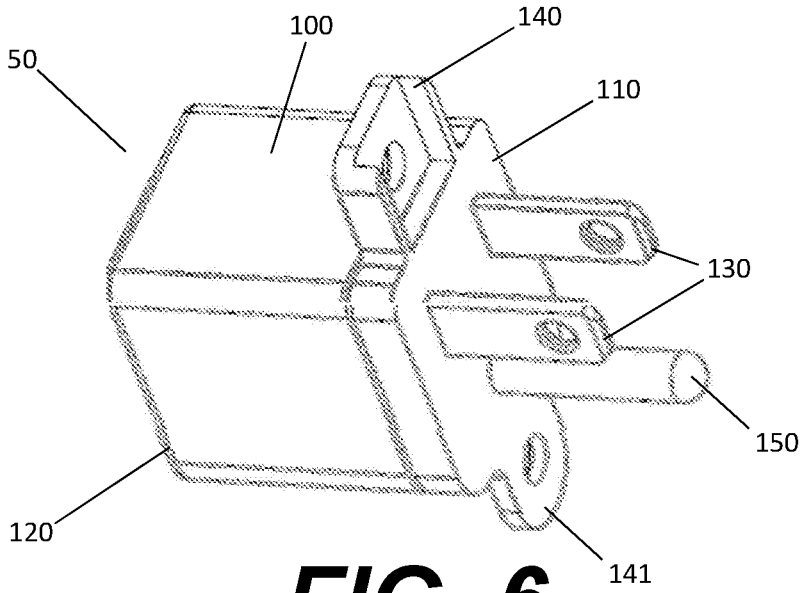
FIG. 6 is an isometric view of an example embodiment showing the surface containing male prongs and fastening tabs.
Figure 6A:
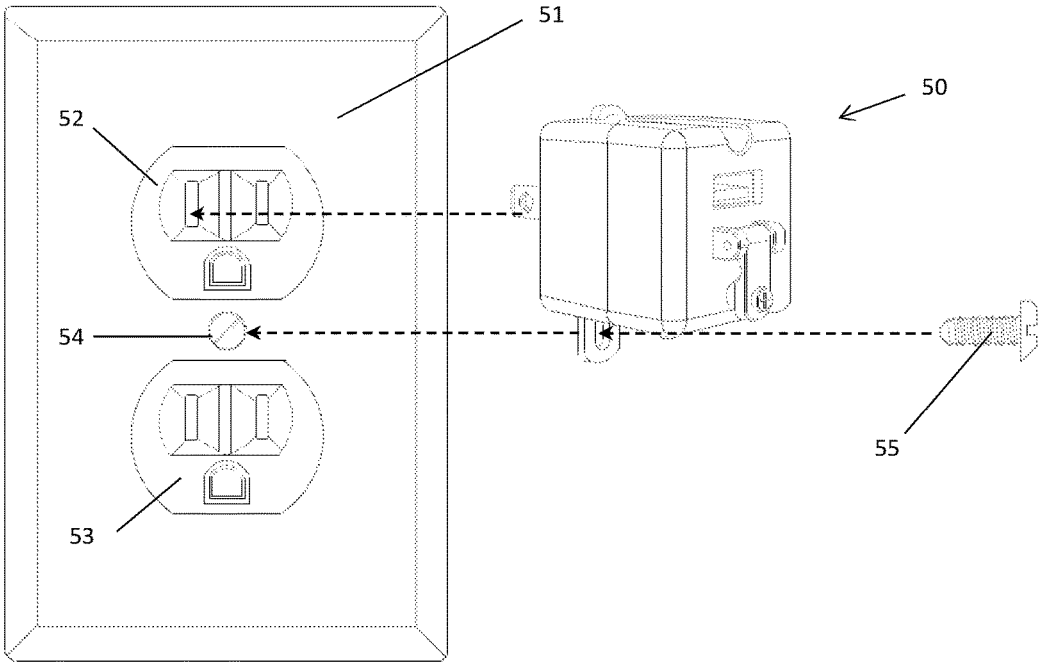
FIG. 6A is an isometric view of an example embodiment showing the an embodiment of the present invention being inserted into a top power outlet.
Figure 6B:
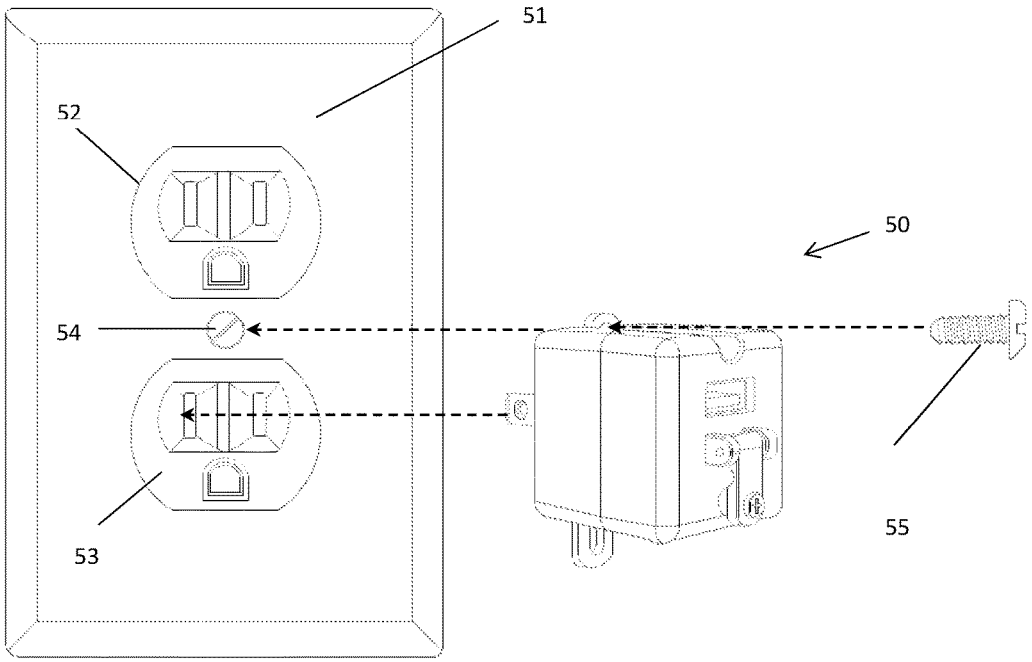
FIG. 6B is an isometric view of an example embodiment showing the an embodiment of the present invention being inserted into a bottom power outlet.

Male end 110 has two male connector prongs 130 extending from the surface of adapter body 100. The two connector male prongs 130 include a positive male prong and a neutral male prong. Male end 110 also optionally has a ground prong 150, as depicted in FIG. 6, extending from the surface of adapter body 100. The two male connector prongs 130 and the male ground prong 150 are composed of conductive material that is typically used for such components, such as copper, brass, or stainless steel. The two male connector prongs 130 and the ground prong 150 are sized and shaped to be inserted into corresponding receptacles in a standard wall outlet. Male connector prongs 130 may optionally be configured as foldable prongs as depicted in FIG. 5. When configured as foldable prongs, prong rotation mechanism 132 is connected to male connector prongs 130 and allows male connector prongs 130 to rotate or fold into the adapter body 100 when adapter 50 is not in use. FIGS. 1-3 also show male connector prongs 130 in the folded position. Foldable prongs are well-known in the art and are not further described here.

Figure 6C:
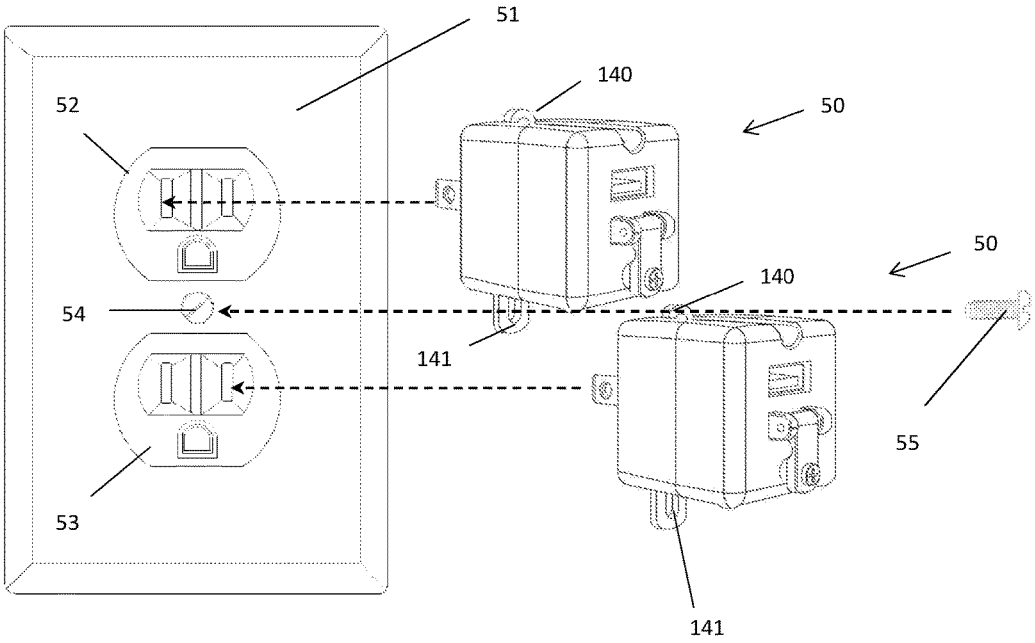
FIG. 6C is an isometric view of two example embodiments of the present invention, one being inserted into a top power outlet and one being inserted into a bottom power outlet.

Male end 110 also has two fastening tabs, a top tab 140, and a bottom tab 141. The two fastening tabs 140, 141 extend from the surface of male end 110 in a plane that is parallel to the orientation of a wall socket to which power adapter 50 is designed to be inserted. Fastening tabs 140, 141 are substantially flat and contain an aperture that is sized and shaped to allow a screw 55 to be inserted through fastening tabs 140, 141 and secured in the faceplate 51 fastening holes 54 of most typical wall outlets, thus securing the entire power adapter 50 to the wall outlet. As depicted in FIG. 6, fastening tabs 140 141 are shaped such that one fastening tab 140 fits into another 141 and allows two adapters to be inserted into and fastened to different sockets on the same wall outlet unit as shown in FIG. 6C. Adapter body 100 has two fastening tabs 140, 141 to accommodate being used in either the top 52 or bottom 53 outlet in a vertically oriented standard wall outlet, as shown in FIGS.

6A and 6B, respectively, or in either the left or right outlet in a horizontally oriented standard wall outlet. Fastening tabs 140, 141 are composed of the same non-conductive material as the adapter body 100, or can alternately be composed of another material that is suitably rigid and durable. Fastening tabs 140 may also be composed of a conductive material and serve as a replacement for a grounding prong. Male end 110 may also have only a single fastening tab 140.

Female end 120 has a female USB receptacle 160. The female USB receptacle 160 is open to and extends into the surface of female end 120. The female USB receptacle 160 is sized and shaped to receive corresponding male USB connections according the USB specification that is well-known in the art. Female USB receptacle 160 may alternately be replaced with another type of female receptacle that is capable of receiving male connections of specified designs for device chargers, such as lightning chargers for Apple iPhones.

Female end 120 also has cord-fastening means 170. As depicted in FIG. 5, cord-fastening means 170 is a latch-style fastener composed of rod 172, lever arm 174, and screw hole 178. Rod 172 is a cylindrical rod composed of plastic, metal, or another suitably rigid material. Rod 172 is secured to adapter body 100 by anchors 171. Anchors 171 protrude from adapter body 100, and contain circular holes of a similar diameter as rod 171. Anchors 171 are composed of similar material to adapter body 100 or another suitably rigid but flexible material. Rod 172 is inserted into anchors 171 and secured by glue, solder, or another suitable adhesive. Rod 172 is inserted through a hole in lever arm 174. Rod 172 allows lever arm 174 to rotate axially about a point near the surface of adapter body 100. Lever arm 174 is composed of similar material to rod 172 or another suitably rigid but flexible material. Lever arm 174 has a hole that allows a screw 176 to be inserted through it and into screw hole 178, in such a manner that lever arm 174 will be secured in place by the inserted screw 176, and any cord that is between lever arm 174 and adapter body 100 will also be secured. Screw hole 178 is a protruding hollow shaft containing threads that allows a standard screw 176 to be inserted and secured. While cord-fastening means 170 has been described as a latch-style fastener, other cord-fastening means are contemplated and compatible with this invention, such as button fasteners, thread fasteners, zip fasteners, rivets, screw fasteners, slide fasteners, clips, groove fasteners, clasp fasteners, or posts to weave/tie/secure the cord to. In alternate fastener designs, there may or may not be a screw, screw hole, hinge, or lever. The securing of the male connection can be applied to the cord, cord's strain relief, or the base of the connection.

FIG. 5 illustrates the internal details of adapter 50, which includes power supply unit 190 and boards 192. Power supply unit 190 is a standard power supply unit that is designed to connect to male connector prongs 130 and USB receptacle 160, providing the required power output to USB receptacle 160 when male connector prongs 130 are connected to an electrical power source such as a standard wall outlet. Power supply unit 190 is well-known in the art and is not described further here. Boards 192 provide mounting support for power supply unit 190, USB receptacle 160, and any other components required for power adapter 50 to function as a power adapter/charger. Boards 192 are well-known in the art and are not described further here.

Figure 7:
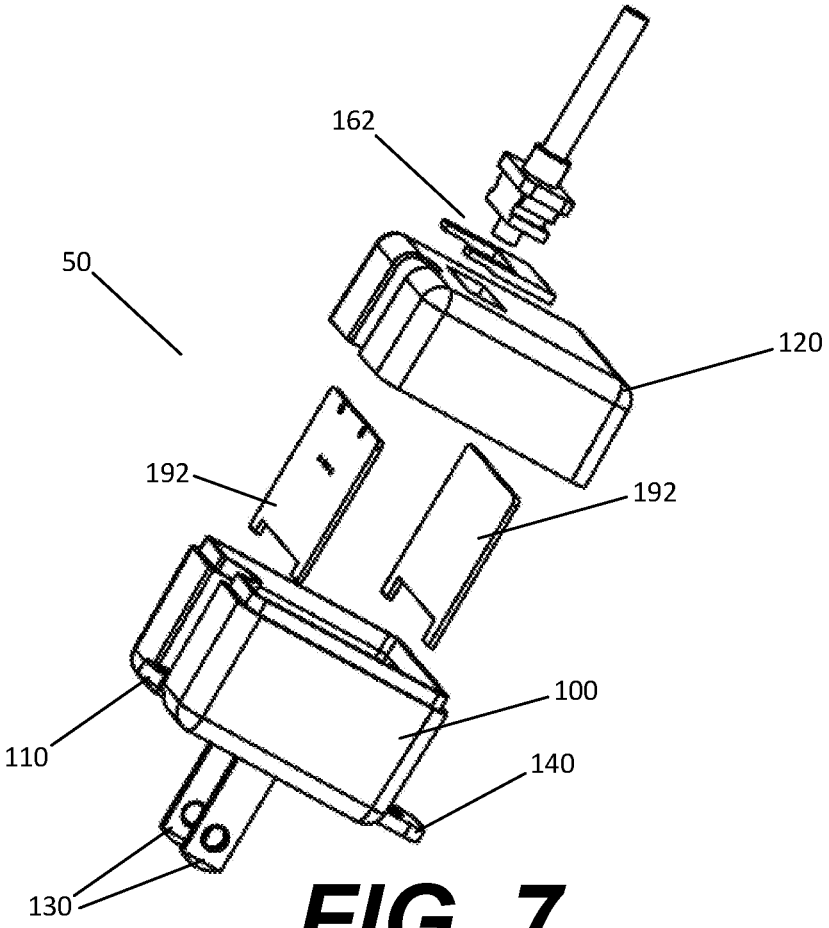
FIG. 7 is an isometric exploded view of the internal structure of an example embodiment showing a fixed cord connection.
Figure 8:
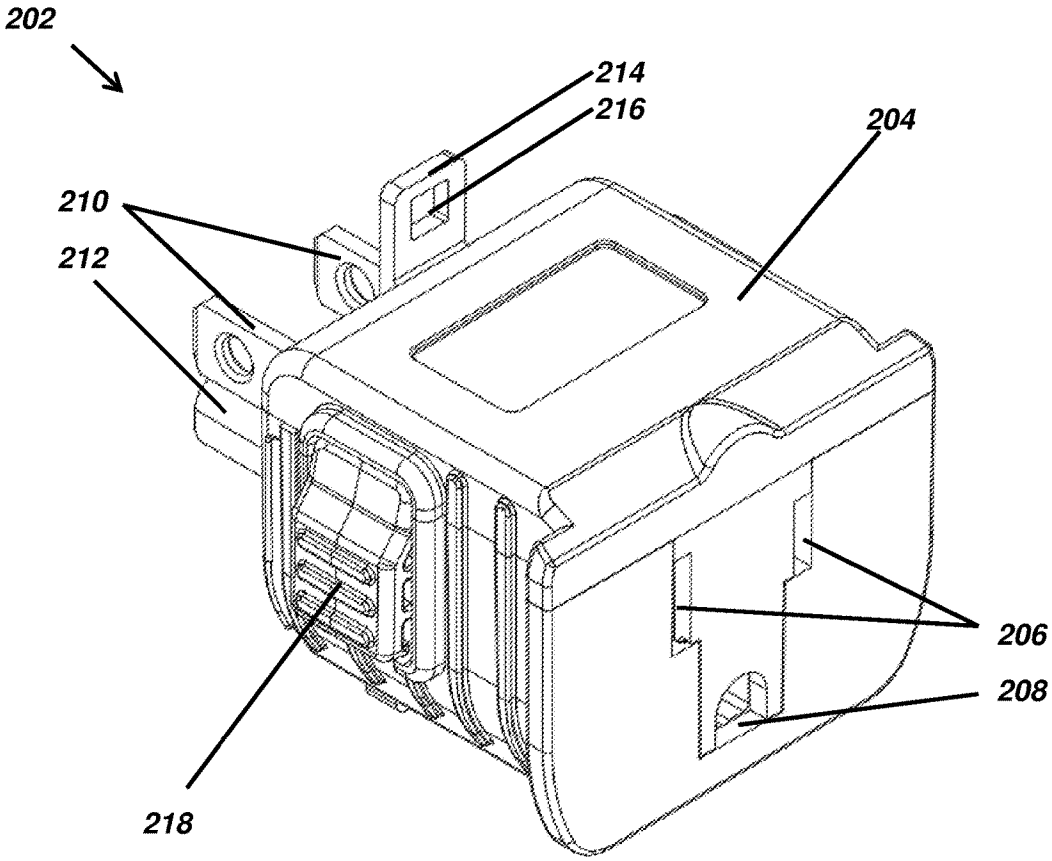
FIG. 8 is a three-dimensional isometric view of an alternative embodiment of the present invention shown from a top-down front face view.
Figure 9:
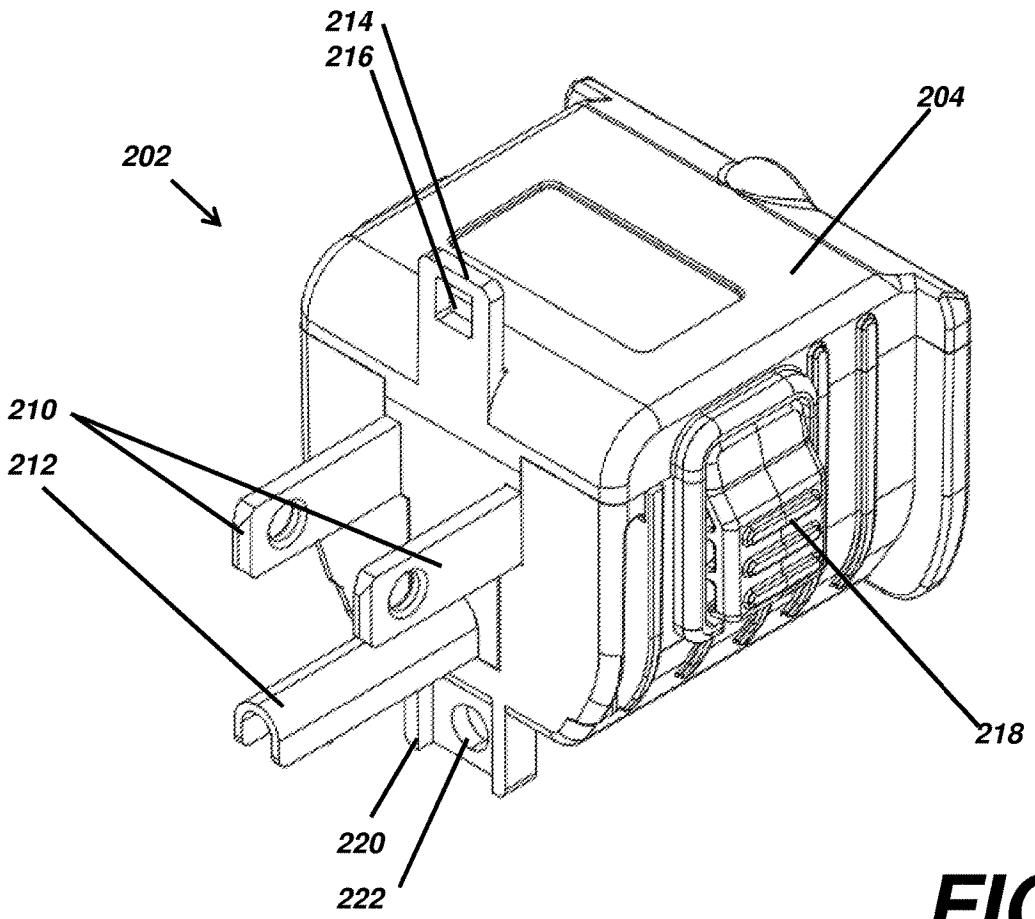
FIG. 9 is a three-dimensional isometric view thereof shown from a top-down, rear face view.
Figure 10:
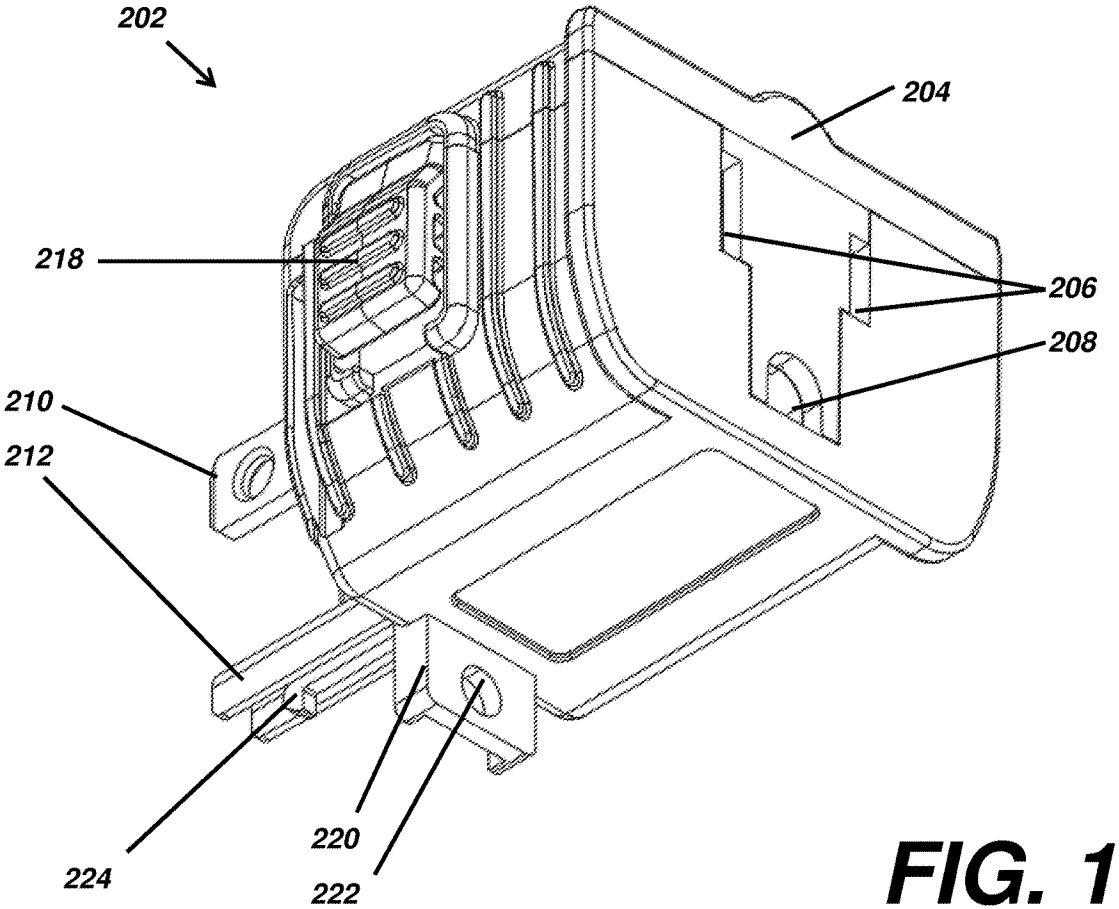
FIG. 10 is a three-dimensional isometric view thereof shown from a bottom-up front face view.
Figure 11:
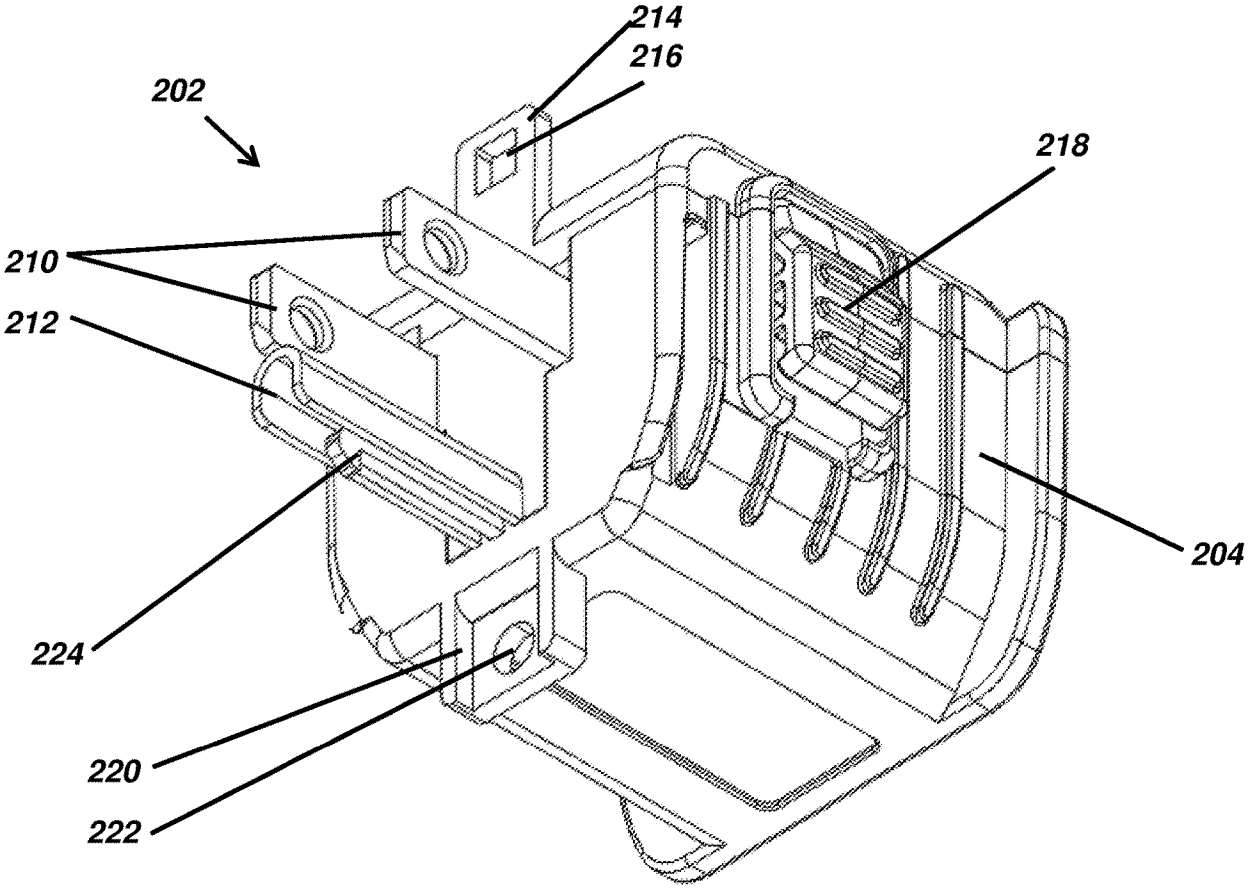
FIG. 11 is a three-dimensional isometric view thereof shown from a bottom-up rear face view.
Figure 12:
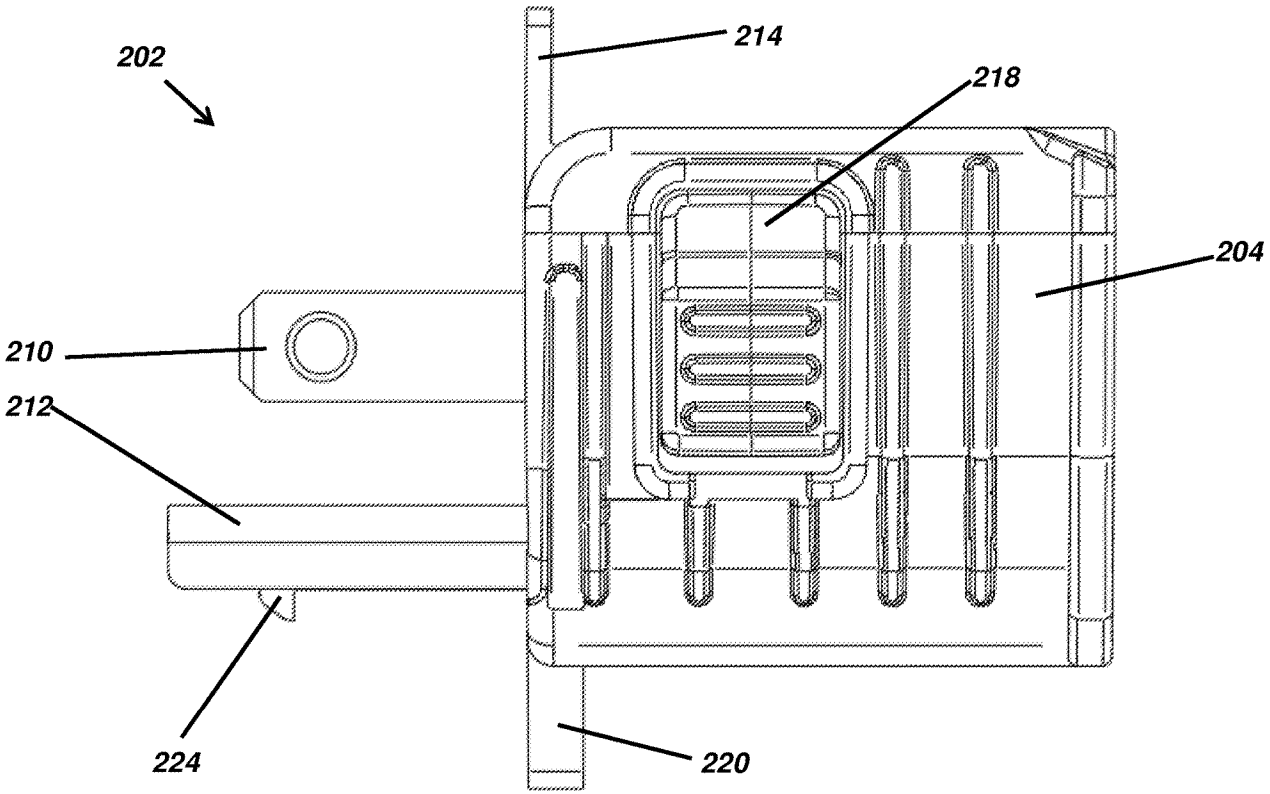
FIG. 12 is a left side elevational view thereof, the right side being a mirror image thereof.
Figure 14:
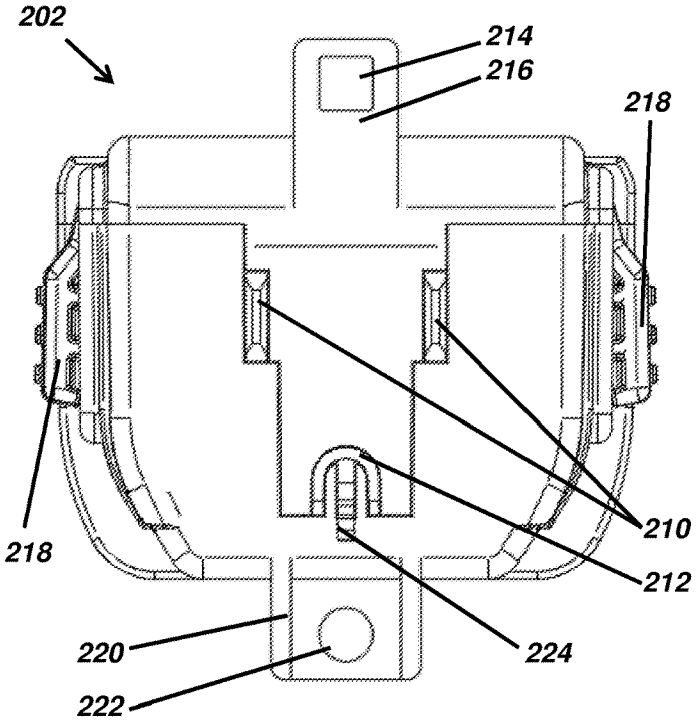
FIG. 14 is a rear face elevational view thereof.
Figure 13:
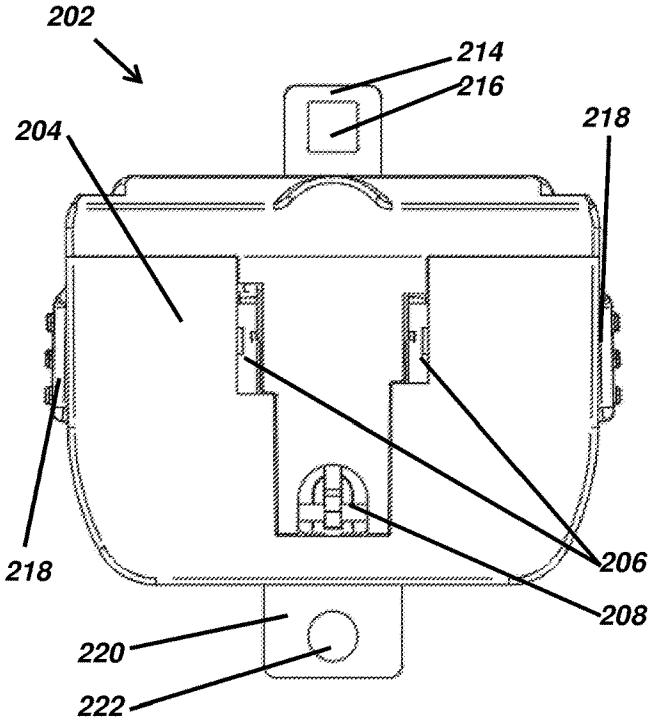
FIG. 13 is a front face elevational view thereof.
Figure 16:
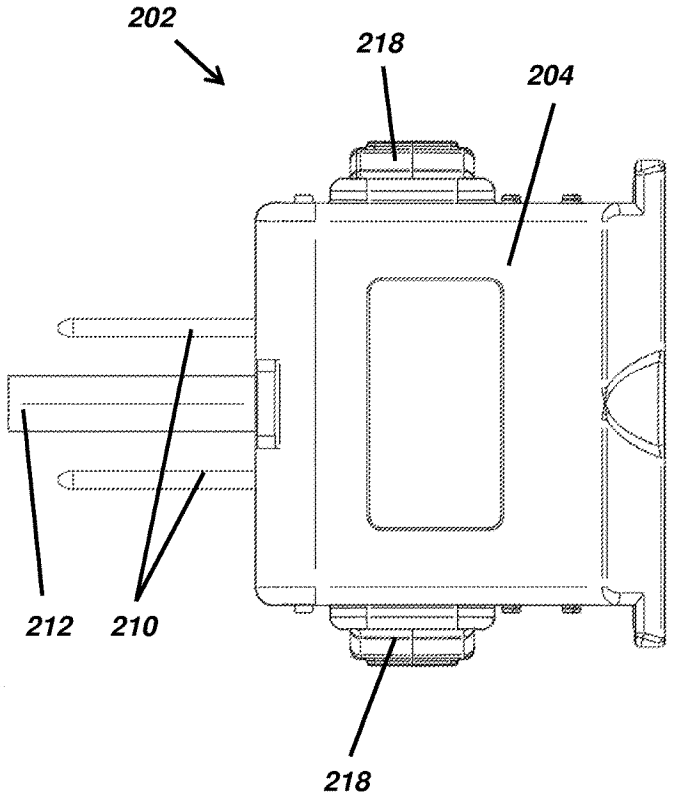
FIG. 16 is a top plan view thereof.
Figure 15:
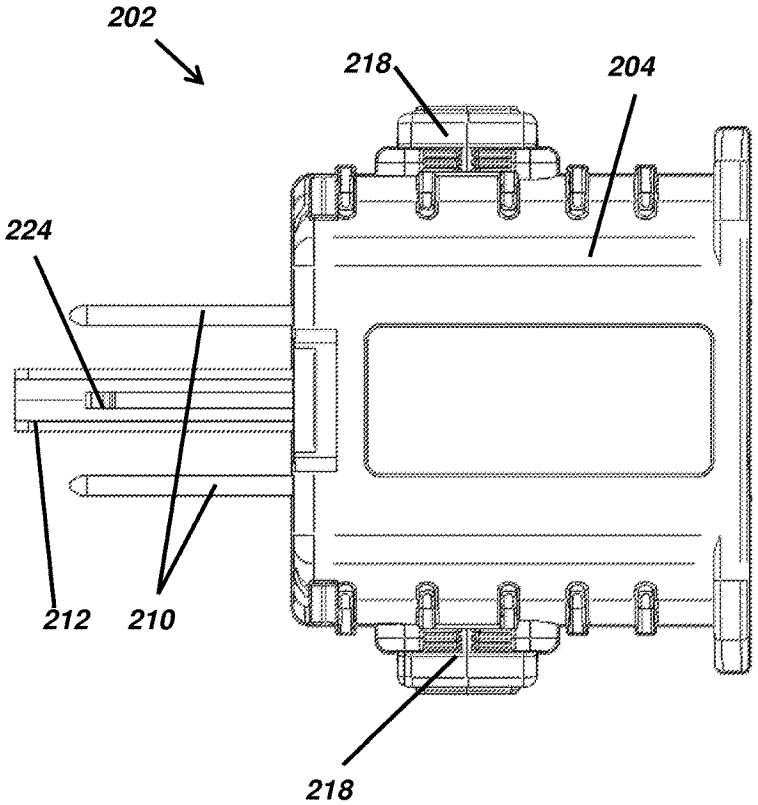
FIG. 15 is a bottom plan view thereof.

FIG. 7 illustrates an alternative configuration where USB receptacle 160 is replaced by fixed cord connection 162. This configuration also lacks cord-fastening means 170 because fixed cord connection 162 is designed to not allow a cord to be removed.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims. Other embodiments may be utilized, and other changes may be made, without departing from the spirit or scope of the subject matter presented herein, for example, female end 120 and corresponding female USB receptacle 160 can be located on a side of adapter body 100 that is adjacent to male end 110, rather than on the side of adapter body 100 that is opposite male end 110, resulting in a perpendicular configuration. Another alternate configuration may include multiple female ends 120 on one power adapter. It will be readily understood that the aspects of the present disclosure, as generally described herein and illustrated in the figures, can be arranged, substituted, combined, separated, and designed in a wide variety of different configurations, all of which are contemplated herein.

III. Alternative Embodiment Lock-in Plug Adapter 202

As shown in FIGS. 8-26, an alternative embodiment lock-in plug adapter 202 is shown. This adapter allows a plug 232 to be securely locked into an outlet 250. The male ends of the plug 234 are secured within the adapter 202, and the adapter's ground plug 212 is securely locked within the ground receiver 252 of the outlet 250. A button 218 is held in place by springs 230 until activated, at which time the adapter and the plug are released to be disconnected.

FIGS. 8-16 show the lock-in plug adapter 202, including its body 204 having a front face with female receiver slots 206 and female ground receiver slot 208, and a rear face with two male prongs 210 and a male ground prong 212. The button 218 is shown along either side of the body, but could conceivably be mounted wherever convenient. For the purposes of the inner workings of this embodiment as discussed in detail below, side mounting the button 218 makes the most practical sense. A top tab 214 with receiver hole 216 and a bottom tab 220 with receiver hole are also shown, and will be discussed in additional detail below.

Figure 22B:
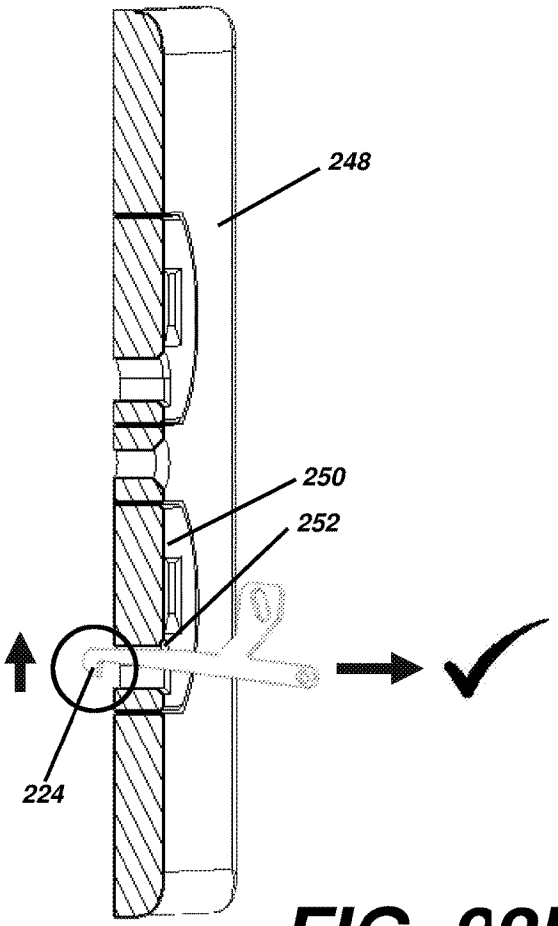
FIG. 22B is a diagrammatic sectional view thereof shown in a second, released orientation.
Figure 22A:
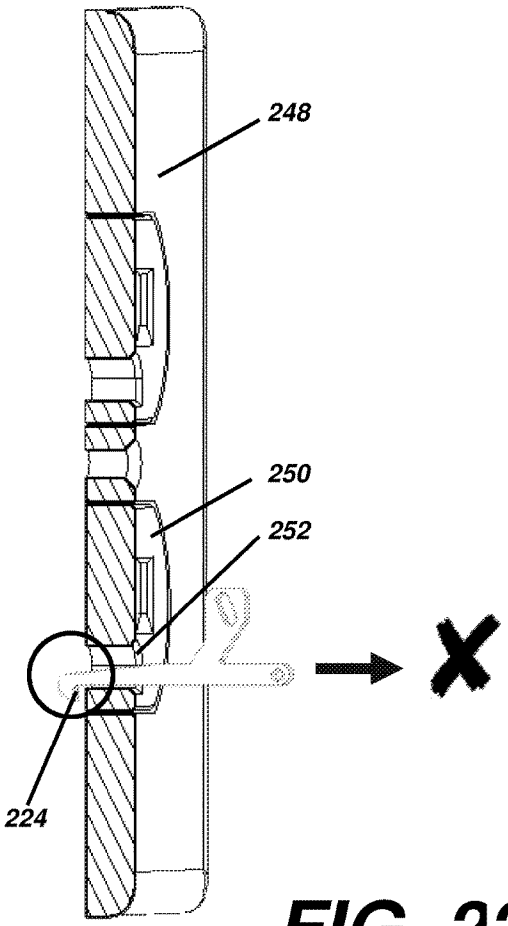
FIG. 22A is a diagrammatic sectional view of a typical environment wall outlet and faceplate showing interaction with elements of the present invention in a first, locked orientation.

The male ground prong 212 has a cavity in its base which includes an arm 242 which ends in a latch 224. This latching element, as shown in FIGS. 22A and 22B secures the adapter 202 within an outlet 250 by grabbing onto the rear face of the outlet and preventing removal unless the button 218 is activate to allow for release.

Figure 17:
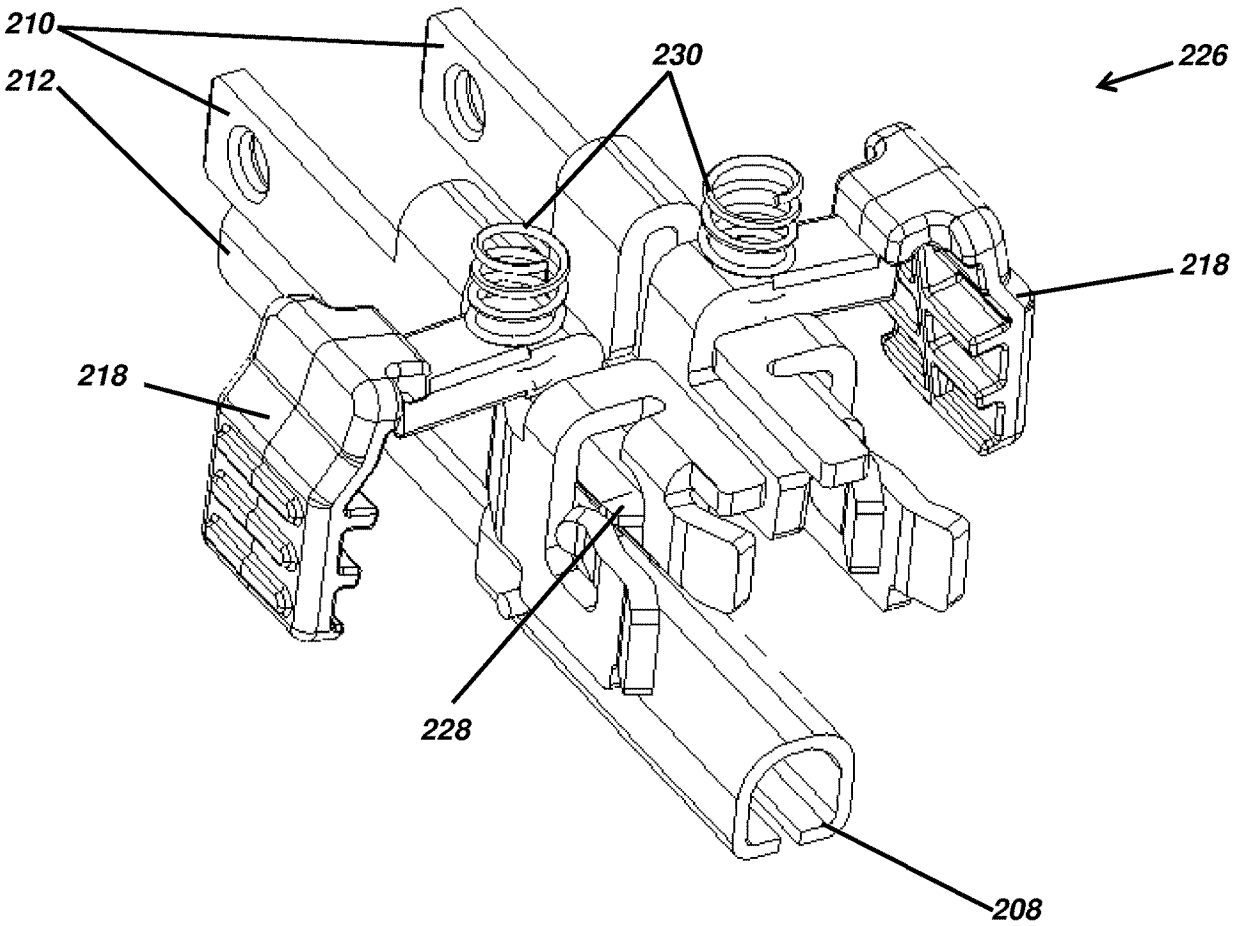
FIG. 17 is a three-dimensional isometric, front face top-down view of internal components of the alternative embodiment thereof.
Figure 18:
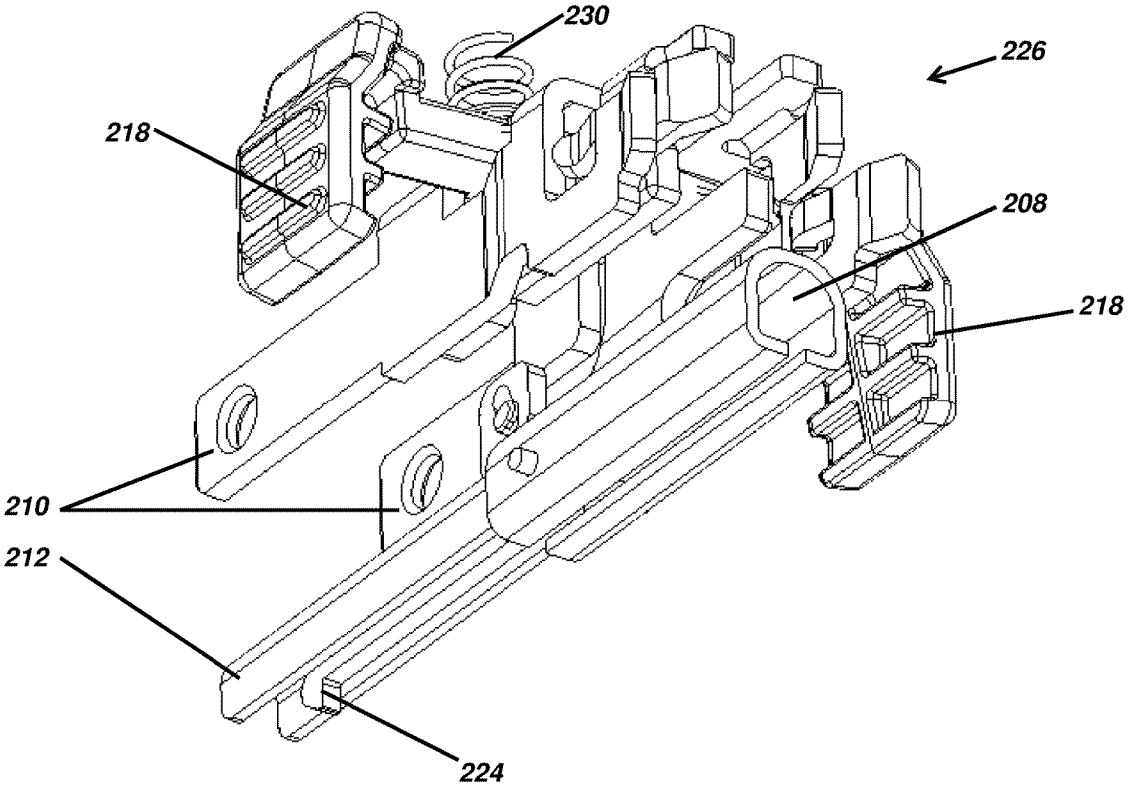
FIG. 18 is a three-dimensional isometric, front face bottom-up view thereof.
Figure 19:
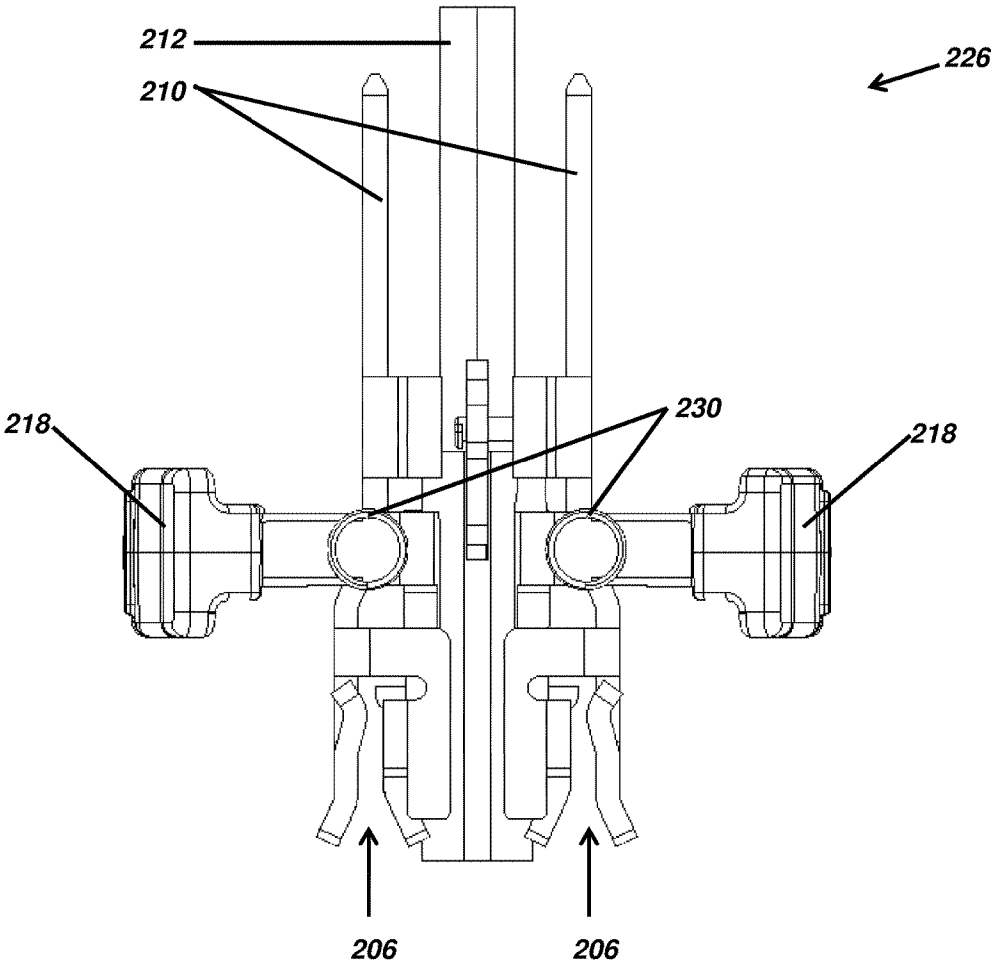
FIG. 19 is a top plan view thereof.

FIGS. 17-19 show the inner elements 226 of the lock-in adapter 202 without its body 204. This includes the springs 230 which ensure that the locking elements remain engaged unless the button 218 is activated. The springs 230 put pressure on the button to ensure no accidental release of the locking elements, including the latch 224.

Figure 20:
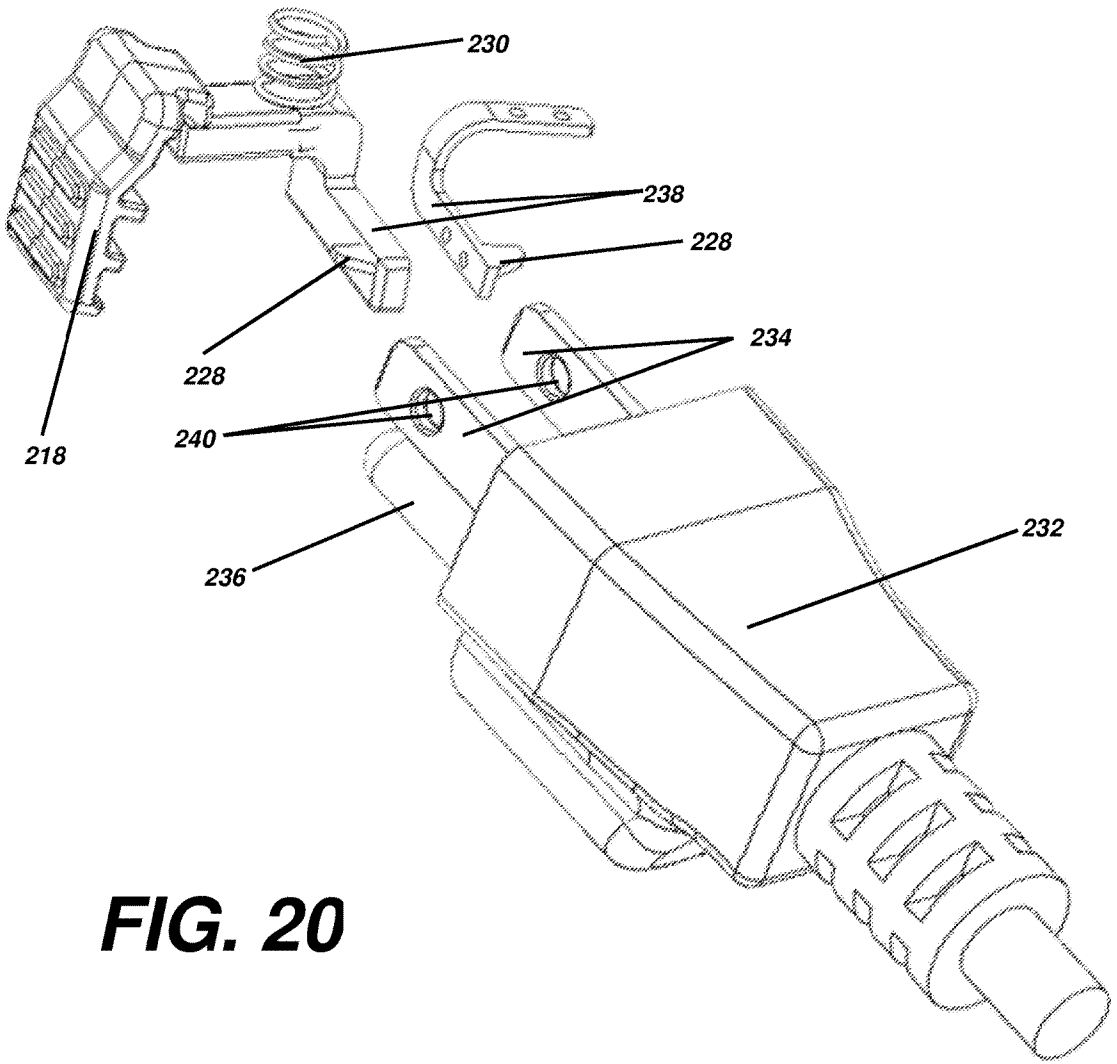
FIG. 20 is a diagrammatic isometric view of components thereof shown interfacing with a typical environment in a plug.

FIG. 20 shows the locking arms 238 and latches 228 which are intended to secure the plug 232 within the adapter 202. The male prongs 234 of the plug 232 include holes 240, as is typical with plugs for electrical devices. The locking arms 238 pivot and the latches 228 lock into these holes 240, preventing the plug 232 from accidental removal from the adapter 202. The same button 218 which activates the arm 242 and latch 224 of the male ground prong 212 of the adapter 202 activates the locking arms 238 which secure the plug. The male ground prong 236 of the plug 232 is also received within the adapter 202.

As shown, the latches 224, 228 include tapered front ends which allow the objects to which they are to engage and lock to pass by the respective latch, tilting it slightly because of the tapered end, and upon passing the tip of the latch the springs 230 force the latches back into position, locking the outlet 250 or male prongs 234 to their respective latches 224, 228.

Figure 21:
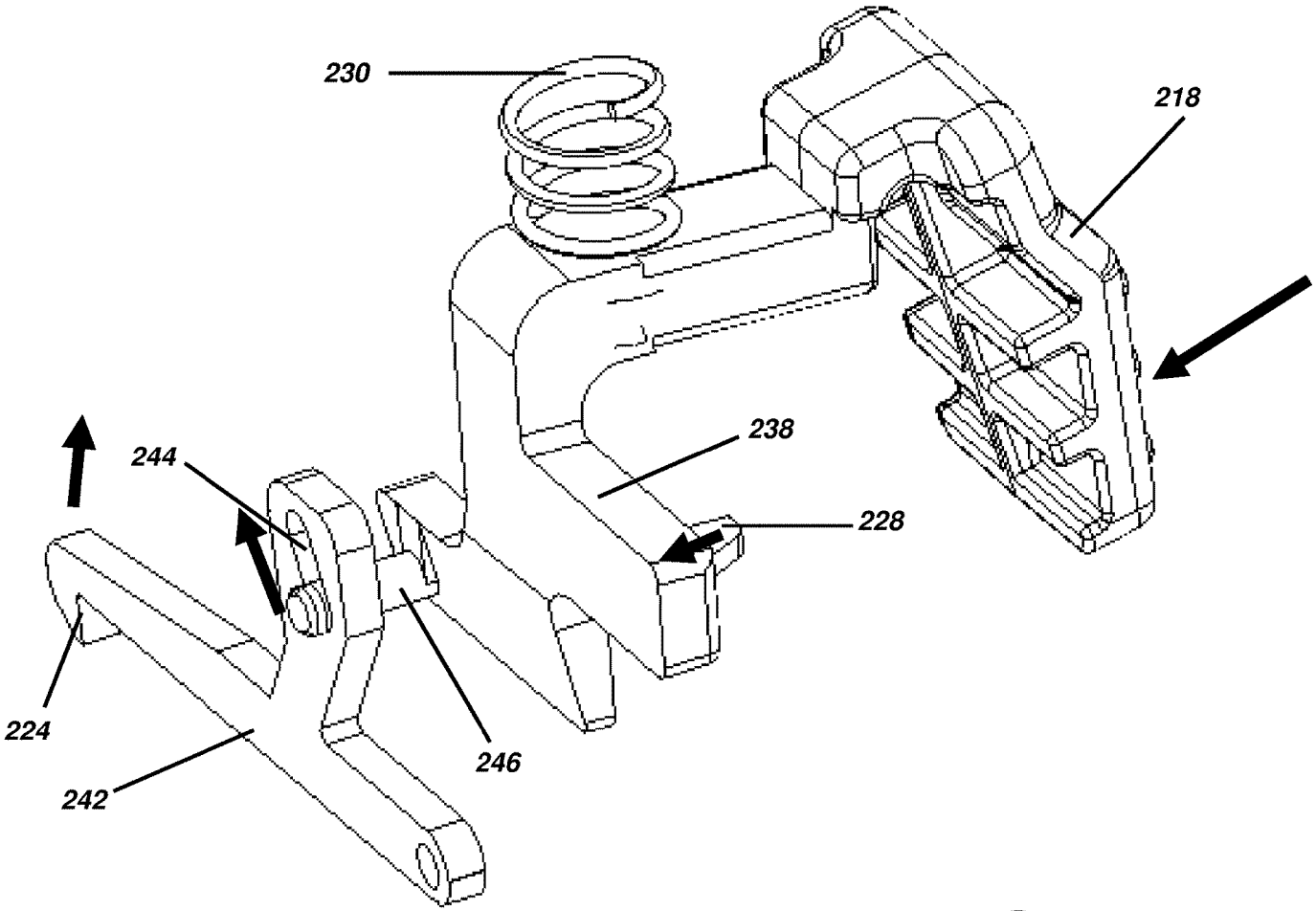
FIG. 21 is a diagrammatic isometric view of components thereof showing how those elements interact.

FIG. 21 shows how the ground prong arm 242 mechanically operates when the button 218 is activated. As with the locking arms 238, the spring 230 ensures that the latch 224 remains in place unless the button 218 is activated. The ground prong arm 242 engages with one of the locking arms 238 via a receiver hole 244 connected to the ground prong arm 242 and a pin 246 connected to the locking arm. As the arrows indicate, when the button is depressed, the ground prong arm 242 raises up releasing the associated latch 224 from the outlet 250, and the locking arm 238 pivots inwardly to release the associated latch 228 from the male prong 234 of the plug 232.

FIGS. 22A and 22B indicate how without operating the button 218 and releasing the latch 224, the latch prevents removal from the outlet 250 and associated faceplate 248 by locking against the back end of the ground prong receptacle 252 within the outlet 250.

Figure 23A:
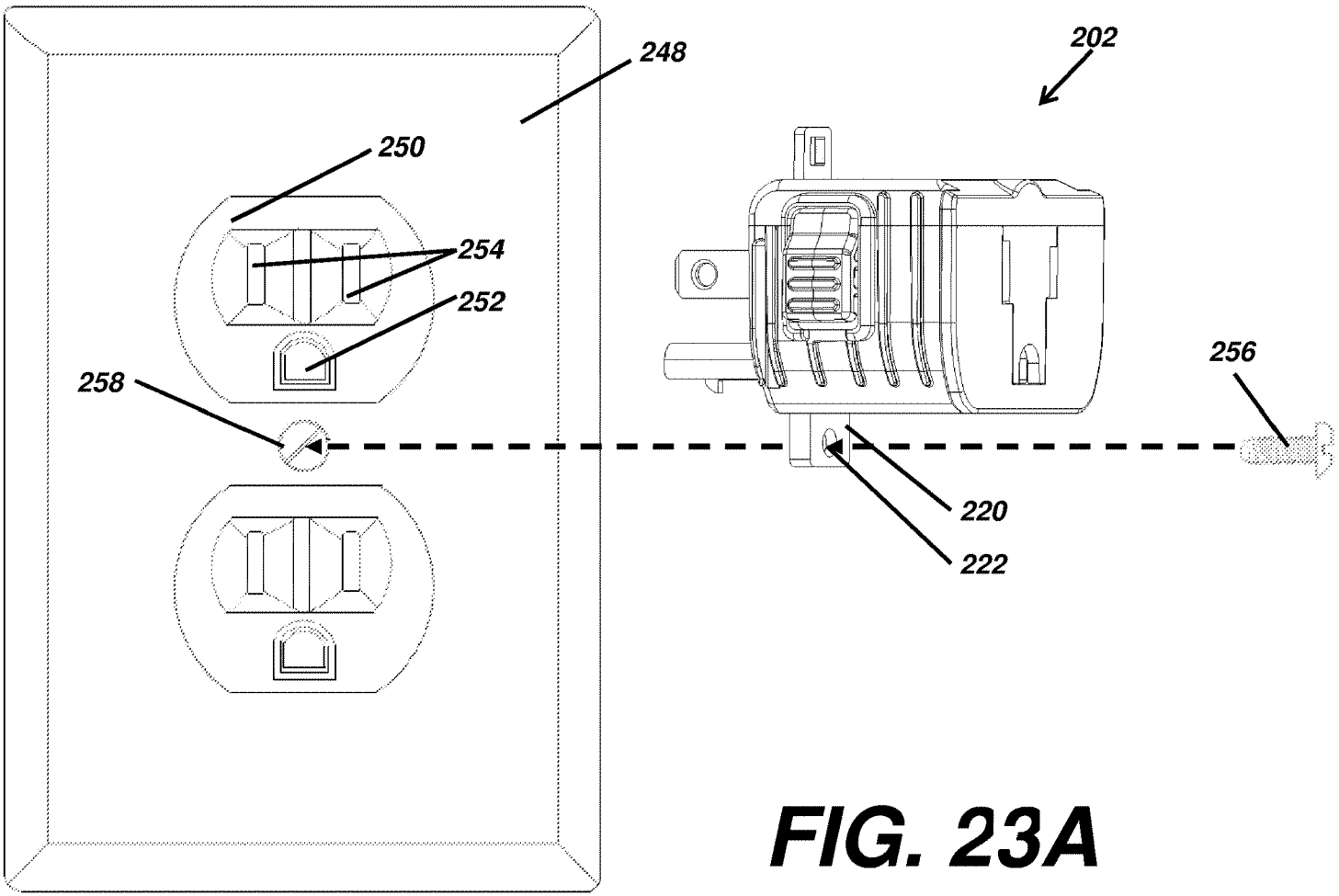
FIG. 23A is a diagrammatic view of the alternative embodiment of FIG. 8 shown interfacing with a typical environment in a wall outlet faceplate.
Figure 23B:
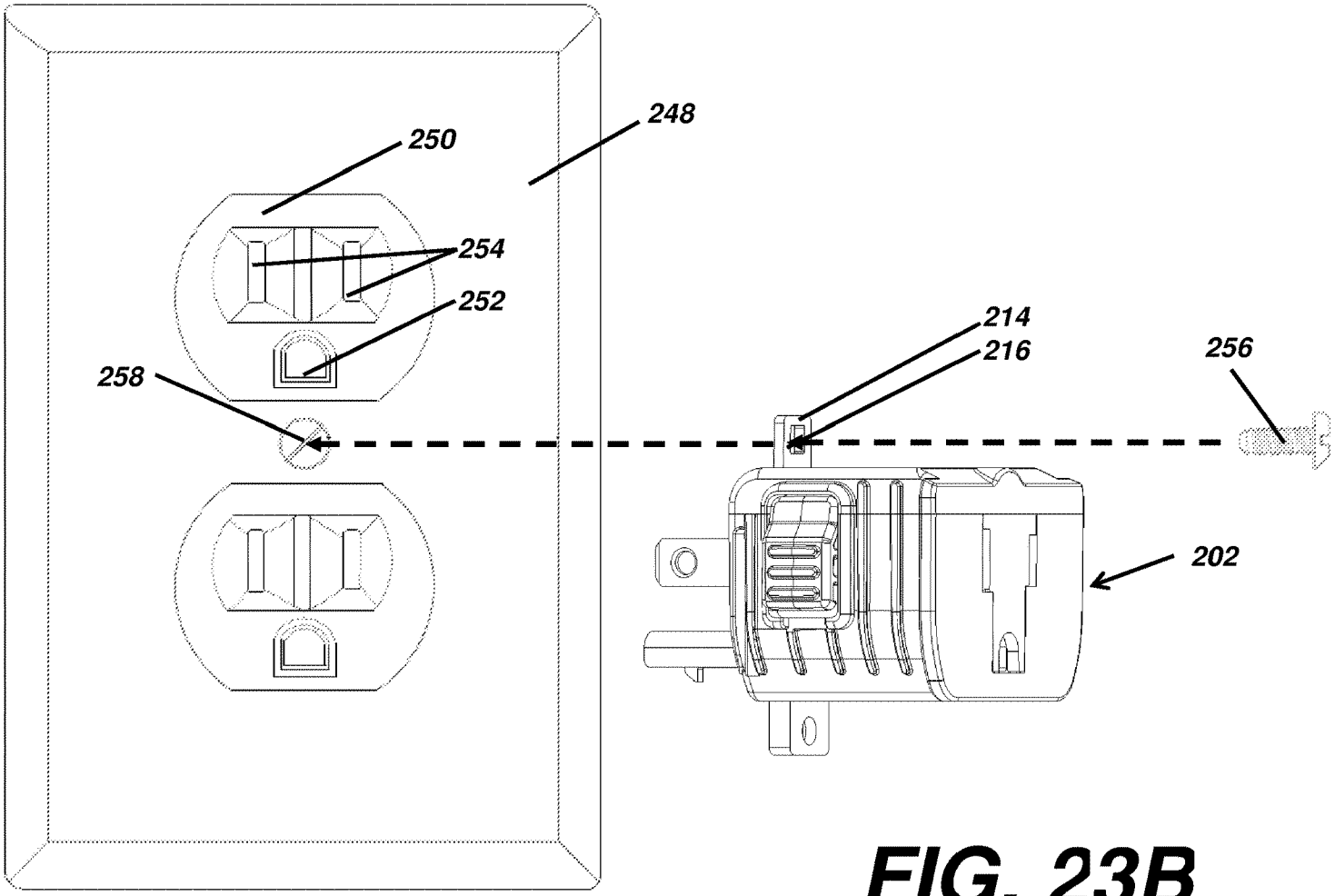
FIG. 23B is another diagrammatic view thereof.
Figure 23C:
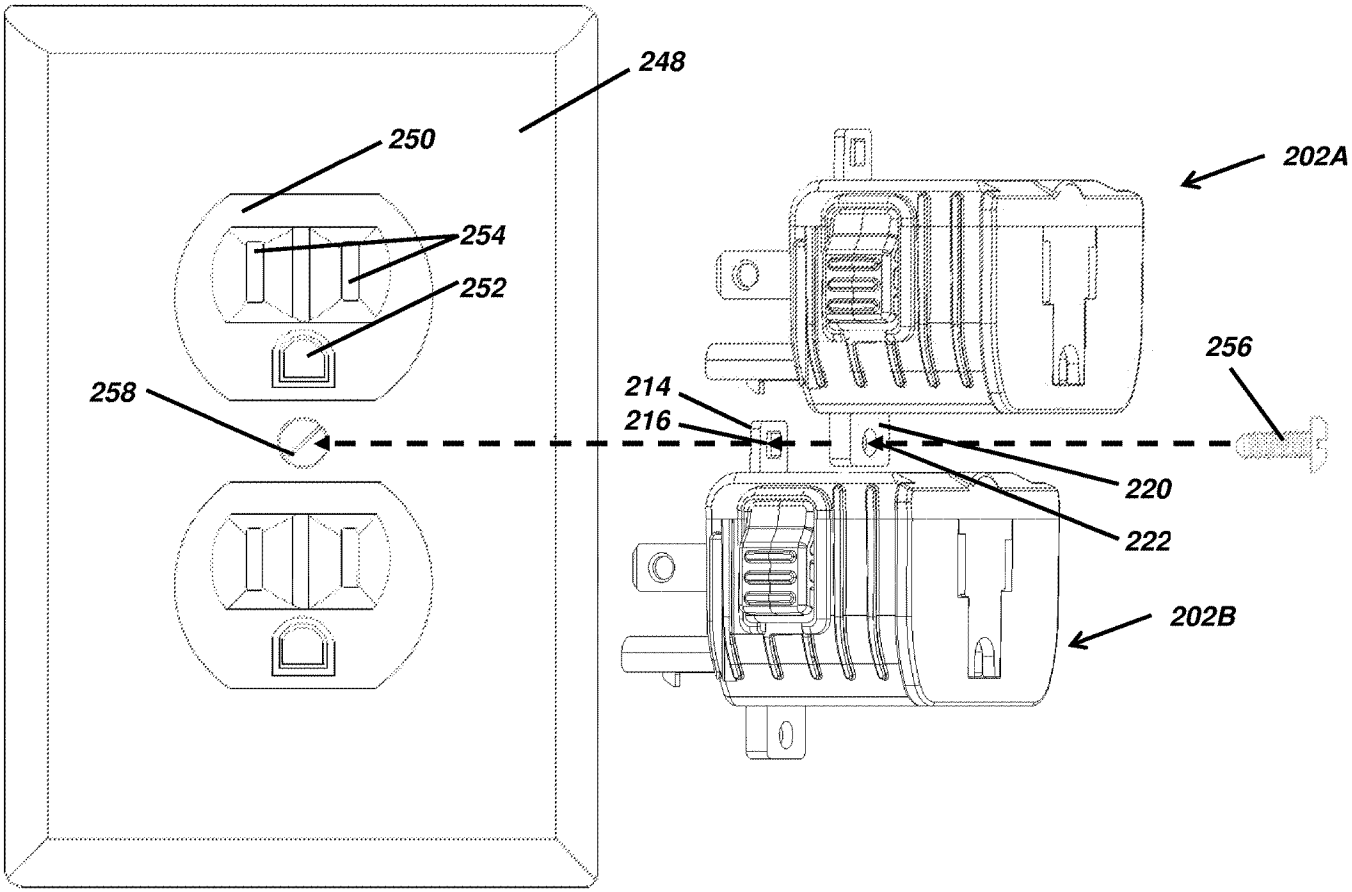
FIG. 23C is another diagrammatic view thereof.

FIGS. 23A-23C show additional features of the present invention which include the top tab 214 with receiver hole 216 and bottom tab 220 with receiver hole 222. Most faceplates 248 for outlets 250 are secured to a wall using a screw. FIG. 23A shows a typical scenario with a single central screw receiver 258 within the faceplate 248. The bottom tab 220 can receive a screw 256 within its receiver hole 222 to further secure the adapter 202 against the faceplate 248, preventing removal of the adapter from the prong receptacles 254 and ground pin receptacle 252 of the outlet 250. FIG. 23B shows a similar scenario where the top tab 214 is used to secure the adapter 202 to the bottom outlet 250 of the faceplate 248 by securing the screw 256 through the top receiver hole 216 into the central screw receiver 258. FIG. 23C shows how two adapters 202A and 202B can both be joined by a single screw 256 through a respective bottom tab 220 receiver hole 222 of a first adapter 202 and a top tab 214 receiver hole 216 of a second adapter 202B.

Figure 25:
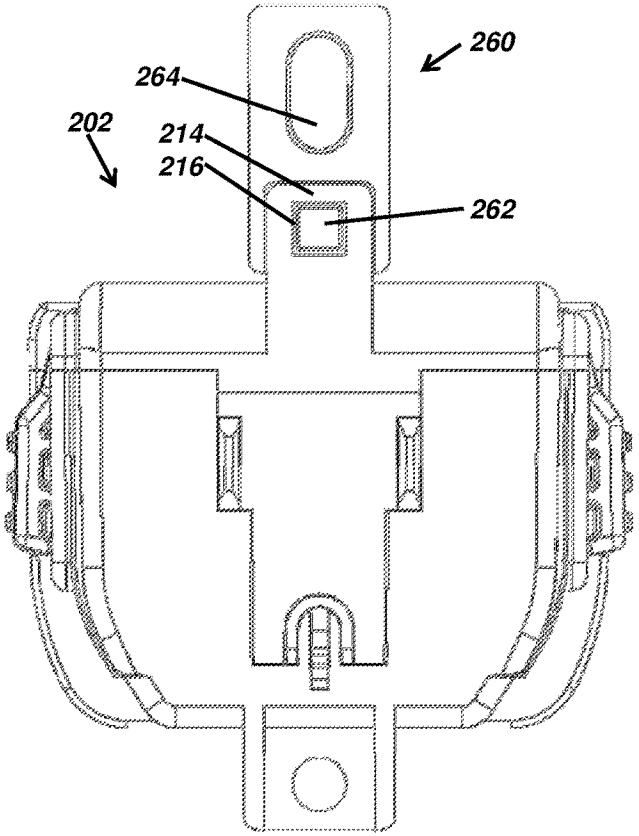
FIG. 25 is a rear elevational view thereof.
Figure 24:
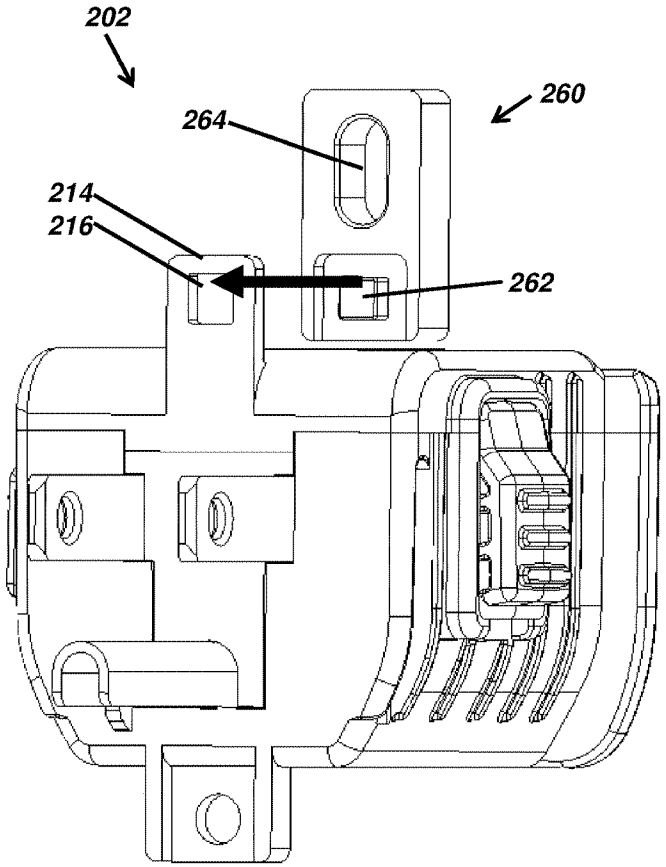
FIG. 24 is a rear three-dimensional view of the present embodiment showing an extender element interfacing therewith.
Figure 26:
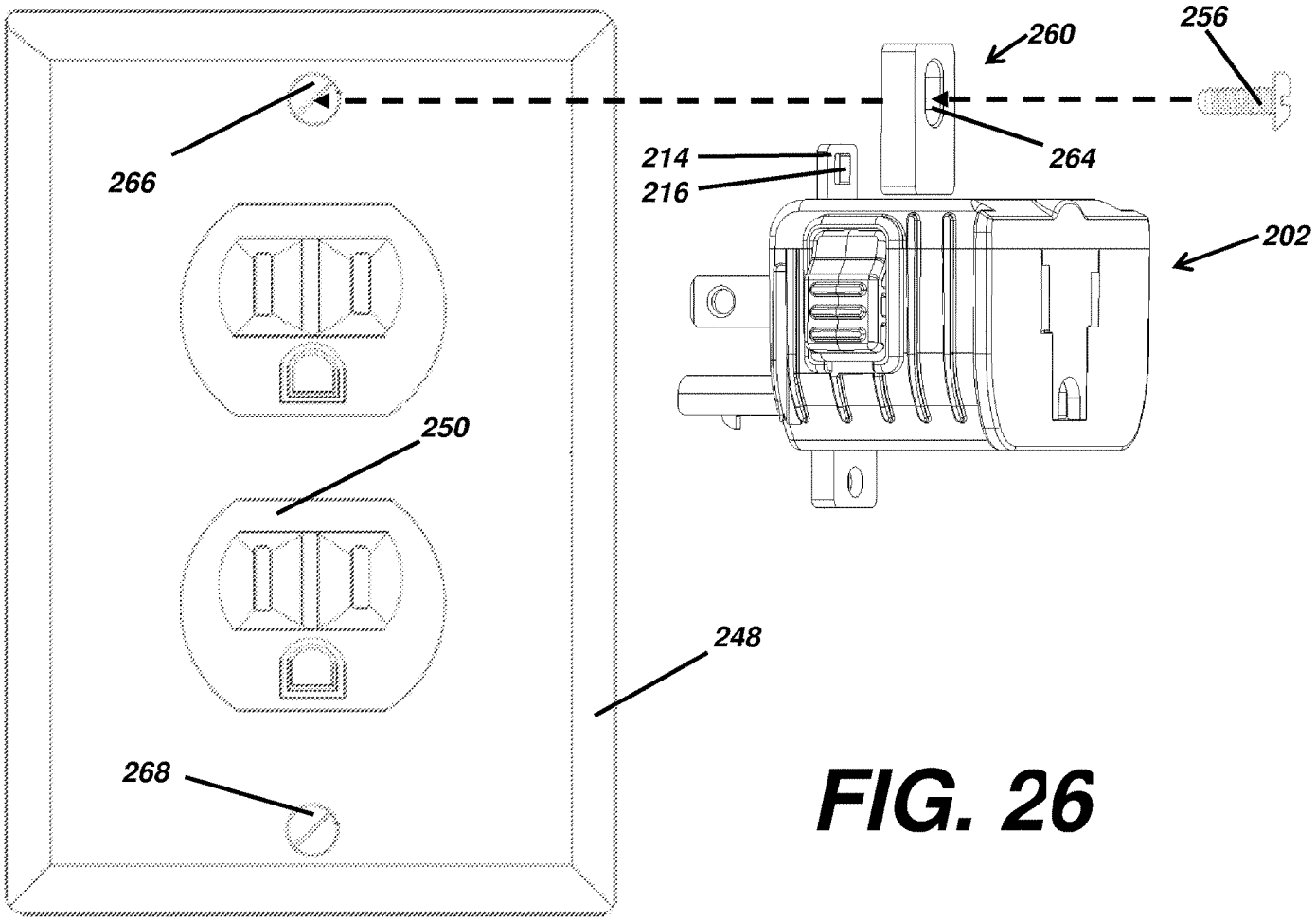
FIG. 26 is a diagrammatic view of the alternative embodiment of FIG. 8 shown interfacing with a typical environment in a wall outlet faceplate using the extender element of FIG. 24.

FIGS. 24-26 show how an extension piece 260 may be joined to the top tab 214 receiver hole 216 for an outlet faceplate 248 having a top screw receiver 266. The extension piece 260 has a notch 262 which inserts into the top tab 214 receiver hole 216, and a screw receiver 264 for receiving the screw 256 for insertion into the top screw receiver 266 as shown in FIG. 26. A similar extender could function for a bottom screw receiver 268 as well. Preferably, as shown in the figures, the top tab 214 receiver hole is square shaped and the bottom tab 220 receiver hole 222 is round to prevent using the incorrect extension piece with the incorrect tab 214, 220, and also to allow for stacking of two adapters 202.

Figure 27:
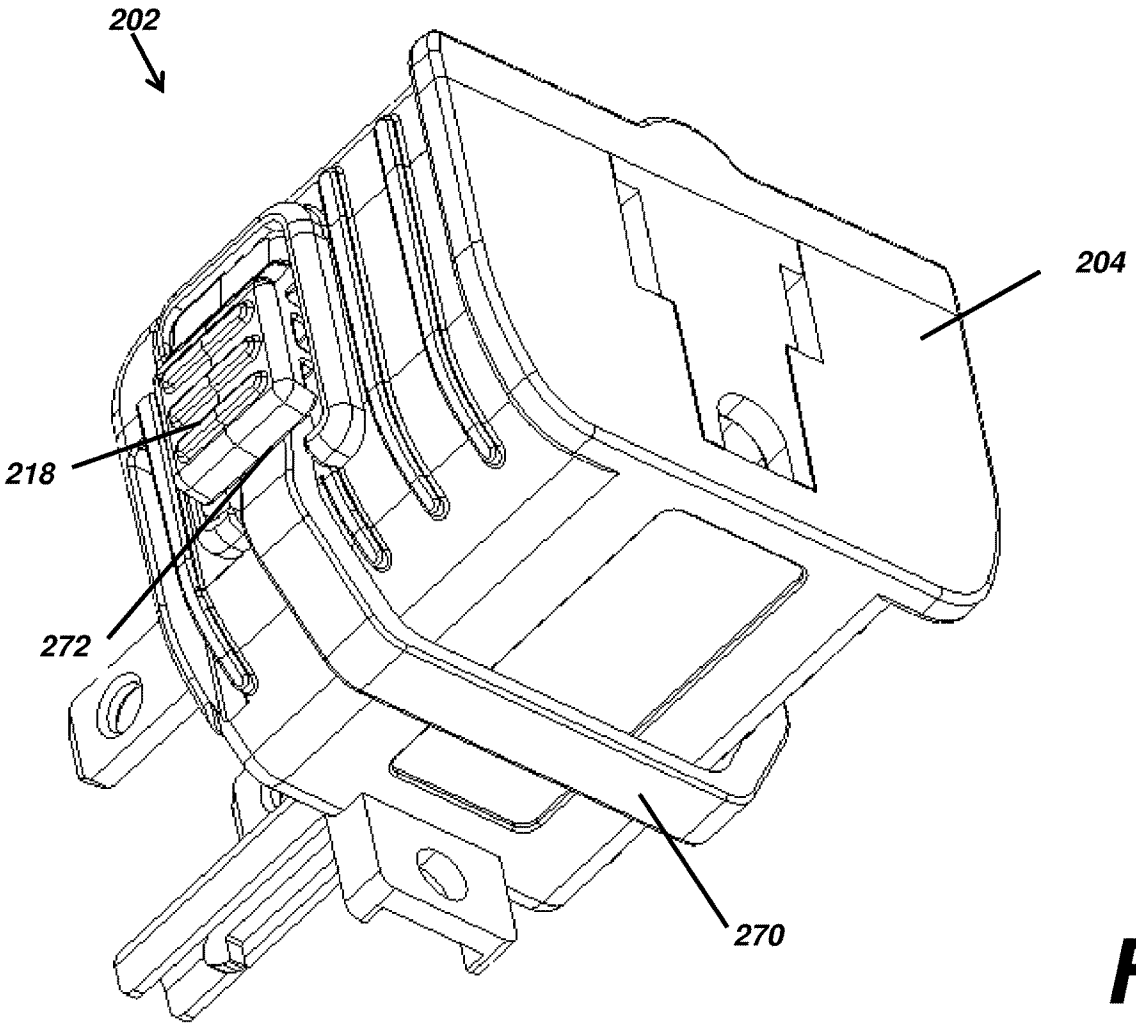
FIG. 27 is a three-dimensional isometric view of an embodiment of the present invention including a button clip element.
Figure 28:
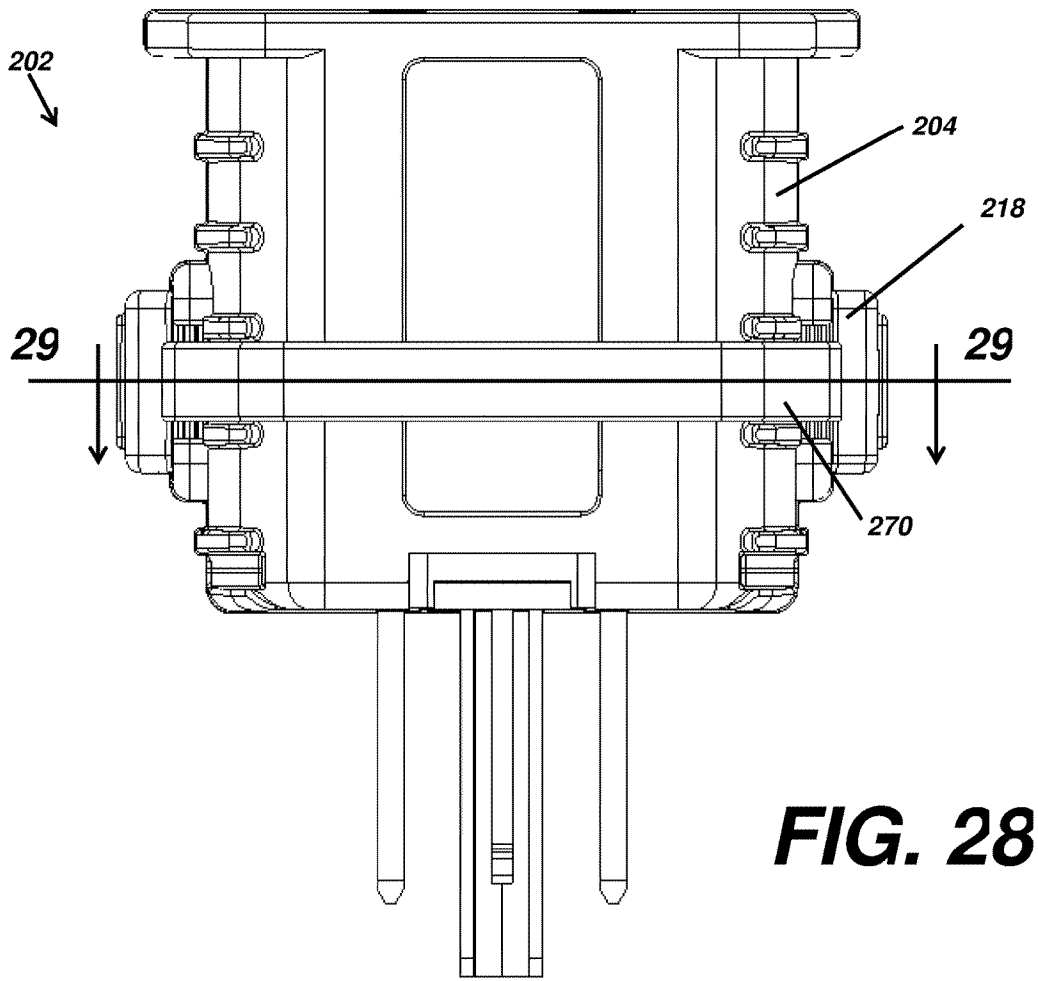
FIG. 28 is a bottom plan view thereof.
Figure 29:
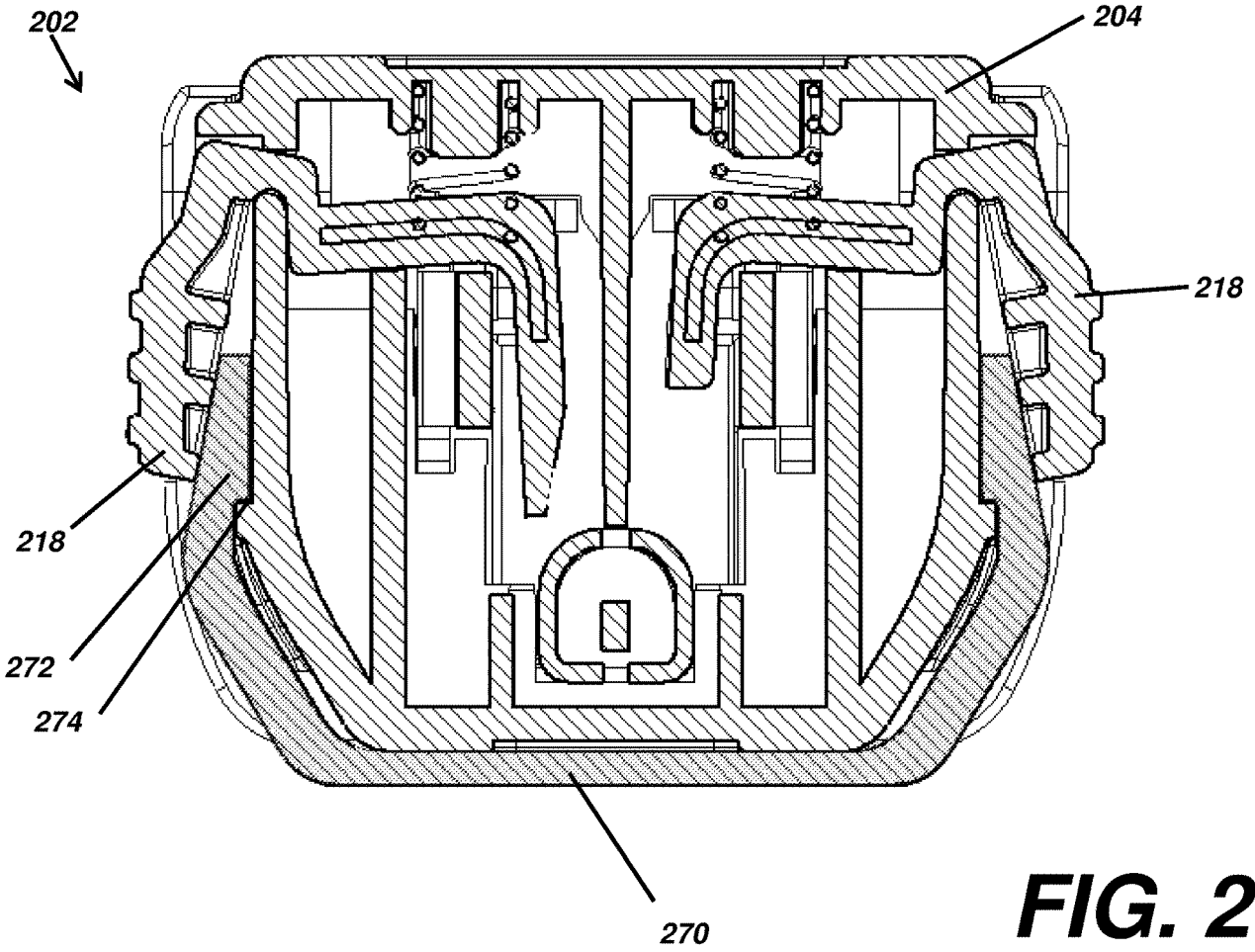
FIG. 29 is a sectional view taken about the line of FIG. 28.

FIGS. 27-29 show the lock-in adapter 202 with a button clip 270 which is used to prevent the buttons 218 from being depressed, and thereby preventing the lock-in adapter 202 from releasing the latch 224 from the wall outlet 250 and also preventing the locking arms 238 from releasing their respective latches 228 from the plug 232 prongs 234. The button clip 270 has notched ends 272 which are received on ledges 274 within the body of the lock-in adapter 202 to secure the button clip 270 into place beneath the buttons 218. Other locking features could also be used to perform a similar function, such as with a screw or clasp, as long as it suitably prevents depressing the button and releasing the plug from the adapter and the adapter from the outlet.

IV. Alternative Embodiment Plug 302

Figure 30:
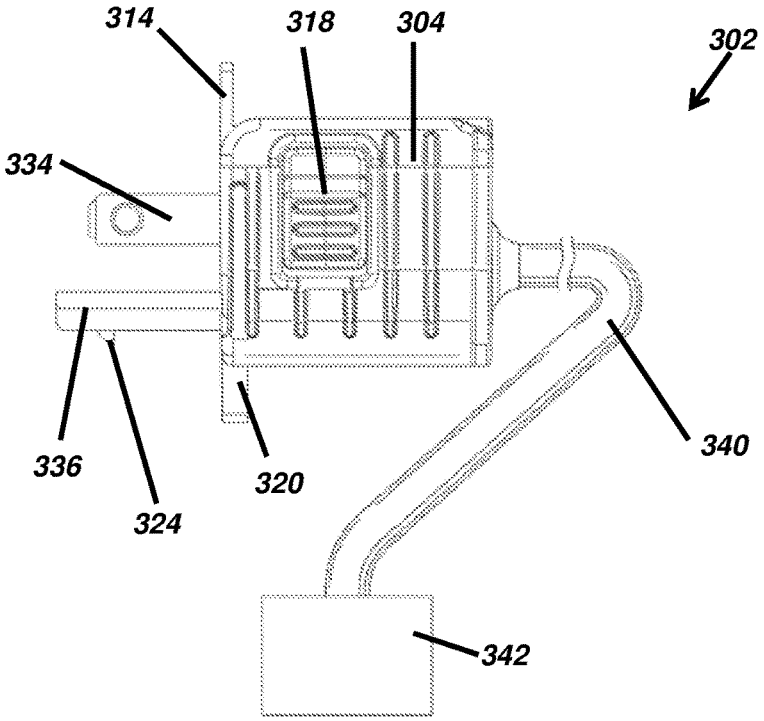
FIG. 30 is a side elevational view of an alternative embodiment thereof.

FIG. 30 shows another alternative embodiment which does not employ an adapter as described above, but includes many of the same features in the end of a plug 302 which could be on the end of a cord 340, such as an extension cord or cord set attached to a device 342 to be powered. As before, it includes a body 304 which has a button or switch 318 for releasing a ground plug hook 324 from a male ground plug 336. Similar hooks could also be deployed in the power plug male ends 334. Top 314 and bottom 320 tabs for receiving screws to further secure the plug 302 to a power outlet are also possible, just as the embodiments disclosed above.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A power adapter comprising:

an adapter body having a first surface and a second surface;

a female receptacle in the first surface of the adapter body comprising a pair of female power prong receptacles and a female ground prong receptacle;

male prongs extending from the second surface of the adapter body comprising a pair of male power prongs and a ground prong;

a pair of locking arms each ending in a respective first and second plug latch, said pair of locking arms located within said adapter body and configured to secure male prongs of a plug inserted into said pair of female power prong receptacles of said first surface of the adapter body by inserting said first and second plug latches into holes located within said male prongs of said plug; and a button configured to selectively release said locking arms from said male prongs of said plug.

2. The power adapter of claim 1, further comprising:

said ground prong comprising a concave recess containing a latch arm ending in a ground latch, said latch arm configured to secure said ground prong within a power outlet receptacle; and said button further configured to selectively release said latch arm from said power outlet.

3. The power adapter of claim 1, further comprising:

a first fastening tab extending from a top edge of the second surface of the adapter body;

said first fastening tab including a first receiver hole configured to receive a mounting screw; and wherein said mounting screw secures said power adapter against said power outlet receptacle by threading through said first receiver hole of said first fastening tab and into a center screw receiver of an outlet faceplate.

4. The power adapter of claim 3, further comprising:

a second fastening tab extending from a bottom edge of the second surface of the adapter body;

said second fastening tab including a second receiver hole configured to receive said mounting screw; and wherein said mounting screw secures said power adapter against said power outlet receptacle by threading through said second receiver hole of said second fastening tab and into said center screw receiver of said outlet faceplate.

5. The power adapter of claim 3, further comprising:

an extension comprising an extension receiver hole and an extension tab;

said extension tab configured for being received within said first receiver hole of said first fastening tab; and said extension receiver hold configured for receiving said mounting screw.

6. The power adapter of claim 2, further comprising:

a spring configured to depress said pair of locking arms and said latch arm, thereby preventing accidental disengagement of said respective ground latch and said first and second plug latches.

7. The power adapter of claim 1, further comprising a latch arm mechanically connected to one of said pair of locking arms.

8. The power adapter of claim 1, further comprising:

a button clip configured to removably engage with said adapter body such that said button clip is received beneath said button; and said button clip further configured to prevent depression of said button.

9. A power plug comprising:

a plug body having a first surface and a second surface;

an electrical cord connecting from a powered device to said first surface;

male prongs extending from the second surface of the adapter body comprising a pair of male power prongs and a ground prong;

said ground prong comprising a concave recess containing a latch arm ending in a ground latch, said latch arm configured to secure said ground prong within a power outlet receptacle;

a button configured to selectively release said latch arm from said power outlet;

a spring configured to depress said latch arm, thereby preventing accidental disengagement of said respective ground latch;

a first fastening tab extending from a top edge of the second surface of the adapter body;

said first fastening tab including a first receiver hole configured to receive a mounting screw;

wherein said mounting screw secures said power adapter against said power outlet receptacle by threading through said first receiver hole of said first fastening tab and into a center screw receiver of an outlet faceplate;

an extension comprising a extension receiver hole and an extension tab;

said extension tab configured for being received within said first receiver hole of said first fastening tab; and said extension receiver hold configured for receiving a mounting screw.

10. The power adapter of claim 9, further comprising:

a second fastening tab extending from a bottom edge of the second surface of the adapter body;

said second fastening tab including a second receiver hole configured to receive said mounting screw; and wherein said mounting screw secures said power adapter against said power outlet receptacle by threading through said second receiver hole of said second fastening tab and into said center screw receiver of said outlet faceplate.

11. A power plug comprising:

a plug body having a first surface and a second surface;

an electrical cord connecting from a powered device to said first surface;

male prongs extending from the second surface of the plug body comprising a pair of male power prongs and a ground prong;

a first fastening tab extending from a top edge of the second surface of the plug body;

said first fastening tab including a first receiver hole configured to receive a mounting screw;

a second fastening tab extending from a bottom edge of the second surface of the plug body;

said second fastening tab including a second receiver hole configured to receive said mounting screw;

an extension comprising an extension receiver hole and an extension tab;

said extension tab configured for being received within said first receiver hole of said first fastening tab;

said extension receiver hold configured for receiving a mounting screw; and wherein said mounting screw secures said power plug against said power outlet receptacle by threading through one of said first receiver hole of said first fastening and said second receiver hole of said second fastening tab and into a center screw receiver of an outlet faceplate.

12. The plug of claim 11, further comprising:

said ground prong comprising a concave recess containing a latch arm ending in a ground latch, said latch arm configured to secure said ground prong within a power outlet receptacle;

a button configured to selectively release said latch arm from said power outlet; and a spring configured to depress said latch arm, thereby preventing accidental disengagement of said respective ground latch.

13. A method of connecting a powered accessory to a power outlet, the method comprising the steps:

plugging two male prongs of a plug into two male receivers of an electrical adapter;

locking said male prongs within said adapter via a pair of locking arms located within said electrical adapter, each of said locking arms each ending in a respective arm latch, and inserting said first and second plug latches into holes located within said male prongs of said plug;

plugging said electrical adapter into an outlet by inserting a pair of male adapter power prongs and a male adapter ground prong into said respective female outlet power receivers and female ground receiver of said outlet; and locking said male adapter ground prong into said female ground receiver of said outlet via a latch arm ending in a ground latch.

14. The method of claim 13, further comprising the step:

depressing a button located on said electrical adapter, thereby releasing said male prongs of said plug from said electrical adapter and said male adapter ground prong from said outlet.

15. The method of claim 13, further comprising the step:

locking a button, said button configured for releasing said male prongs of said plug from said electrical adapter and said male adapter ground prong from said outlet.

16. The method of claim 15, further comprising the step:

placing a button clip beneath said button, said button clip configured for locking into place beneath said button and preventing said button from being depressed.

17. The method of claim 13, further comprising the step:

inserting a mounting screw through a receiver hole of a fastening tab extending from the adapter body; and securing said power adapter against said outlet by inserting said mounting screw into a center screw receiver of an outlet faceplate housing said outlet.

18. The method of claim 13, further comprising the step:

connecting an extension arm into a receiver hole of a fastening tab extending from the adapter body;

inserting a mounting screw through a receiver hole of said extension arm; and securing said power adapter against said outlet by inserting said mounting screw into a screw receiver selected from the list comprising: a top screw receiver of an outlet faceplate housing said outlet; and a bottom screw receiver of said outlet faceplate housing said outlet.

* * * * *